United States Patent [19]

Eisermann

[11] Patent Number: 5,072,604

[45] Date of Patent: Dec. 17, 1991

[54] CLOSURE SYSTEM CONSISTING OF A LOCK AND A PLURALITY OF KEYS

[75] Inventor: Armin Eisermann, Velbert, Fed. Rep. of Germany

[73] Assignee: Schulte-Schlagbaum Aktiengesellschaft, Velbert, Fed. Rep. of Germany

[21] Appl. No.: 234,813

[22] Filed: Aug. 22, 1988

[30] Foreign Application Priority Data

Aug. 22, 1987 [DE] Fed. Rep. of Germany ..... 3728073
Dec. 17, 1987 [DE] Fed. Rep. of Germany ..... 3742826

[51] Int. Cl.[5] ..... E05B 25/00; E05B 47/00

[52] U.S. Cl. ..... 70/276; 70/383; 70/384

[58] Field of Search ..... 70/276, 382–385, 70/413

[56] References Cited

U.S. PATENT DOCUMENTS

| | | | |
|---|---|---|---|
| 1,136,067 | 4/1915 | Watson | 70/383 |
| 3,234,768 | 2/1966 | Russell et al. . | |
| 4,312,198 | 1/1982 | Sedley | 70/276 |
| 4,516,417 | 5/1985 | Parrock | 70/384 |
| 4,519,228 | 5/1985 | Sornes | 70/276 |
| 4,644,766 | 2/1987 | Lovell | 70/276 |
| 4,676,083 | 6/1987 | Sedley et al. | 70/276 |
| 4,686,841 | 8/1987 | Prunbauer et al. | 70/276 |
| 4,712,402 | 12/1987 | Monahan | 70/383 |
| 4,727,975 | 3/1988 | Eisermann | 70/276 X |

FOREIGN PATENT DOCUMENTS

| | | |
|---|---|---|
| 0024242 | 2/1983 | European Pat. Off. . |
| 2401602 | 7/1974 | Fed. Rep. of Germany . |

OTHER PUBLICATIONS

Corkey Control Systems Inc., 1986.

*Primary Examiner*—Lloyd A. Gall
*Attorney, Agent, or Firm*—Martin A. Farber

[57] ABSTRACT

A closure system consists of lock and several keys in which the closing of the lock, determined by mechanically or magnetically controllable tumblers, is variable in such a manner that a closure code of the lock which corresponds initially to the coding of the first key can be varied by rearrangement of at least one tumbler element (28) within the lock, in response to the coding of a successor key. This negates need for a tool or hand knob. Displacement of the tumbler element (28) be effected by means of the corresponding successor key (36) in the manner that successor keys (36) are divided into a first region (A) associated exclusively with a closure code of the tumblers and a second supplementation region E which enters into action when the first region agrees with the closure code of the tumblers. This shifts the tumbler element (28) into the position acted on by the supplementation region of the next successor key.

23 Claims, 23 Drawing Sheets

FIG.31
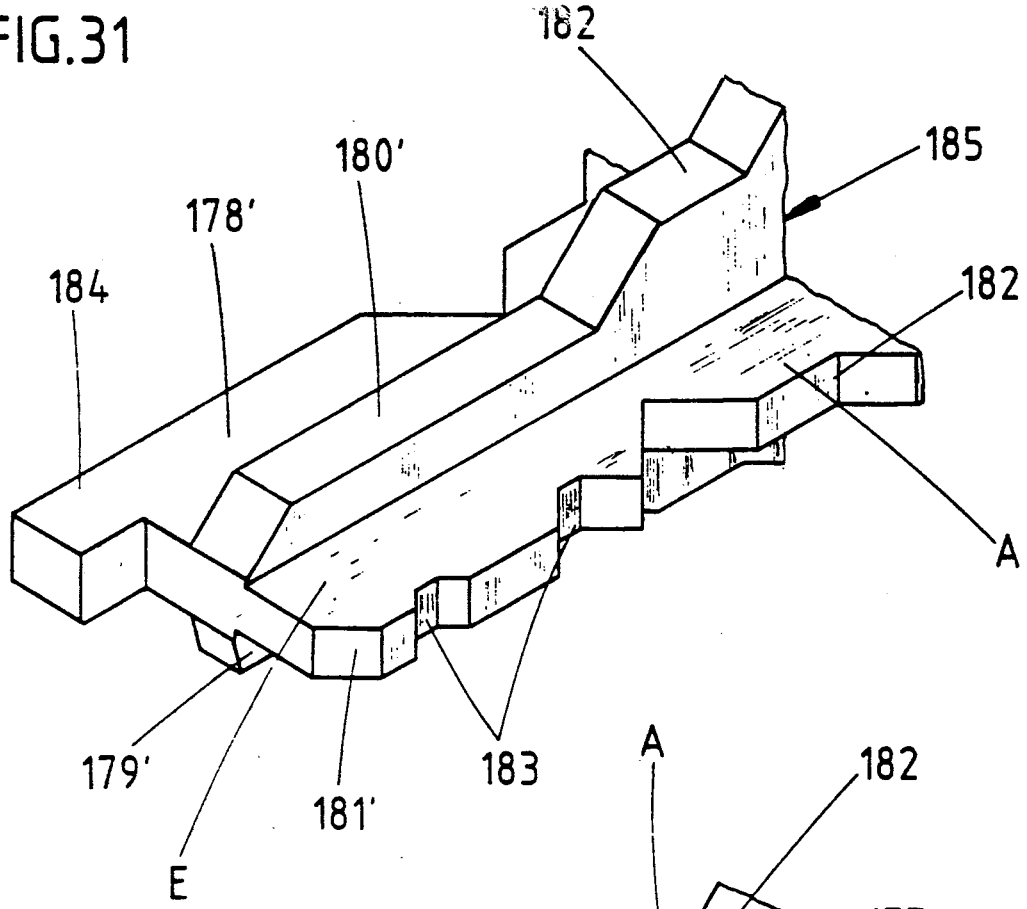
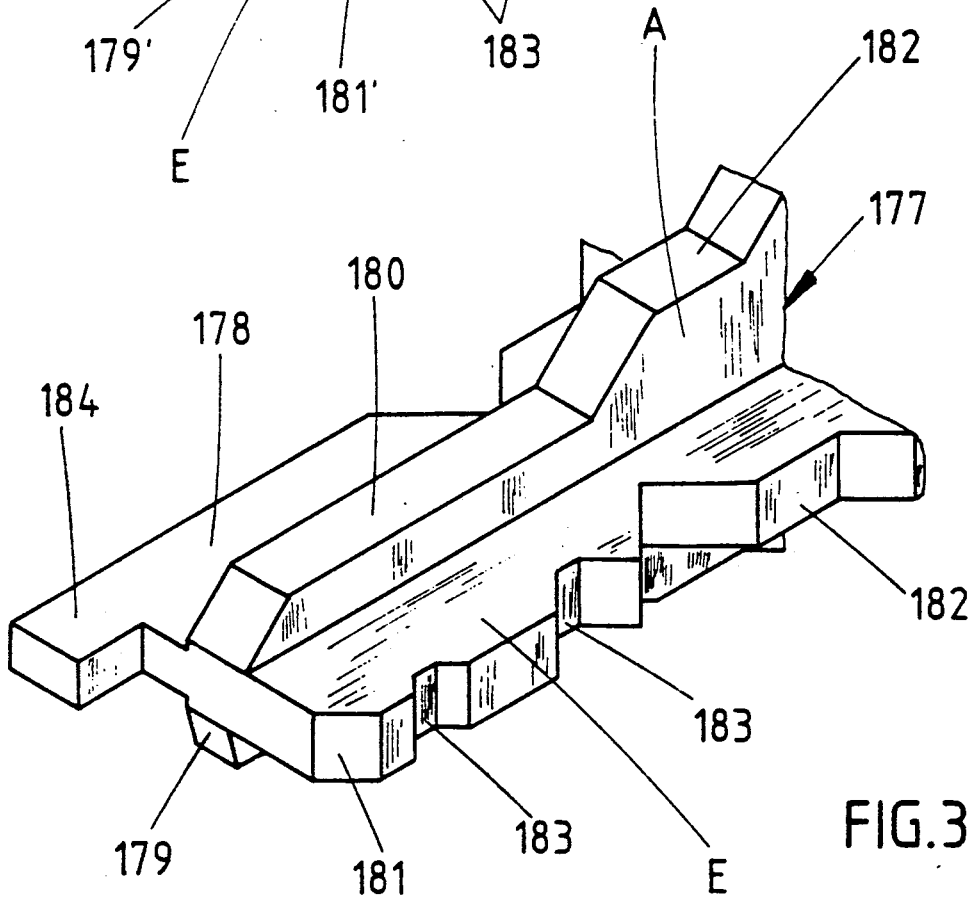
FIG.30

CLOSURE SYSTEM CONSISTING OF A LOCK AND A PLURALITY OF KEYS

FIELD AND BACKGROUND OF THE INVENTION

The present invention relates to a closure system, particularly for door locks, in which the closing of the lock determined by mechanically or magnetically controllable tumblers is variable in that a closure code of the lock corresponds initially to a coding of a first key, and can be varied by reshifting of at least one tumbler element within the lock to the coding of a successor key.

In the known devices of this type which operate on the basis of magnetic release of the closure (European Patent 24 242), the recoding is effected by a tool, for instance in the form of an insertion key, which can be inserted from the outside into the lock through an opening in the lock cover. This key engages into the center of a rotatable carrier. In the rotatable carrier there is located at least one permanent magnet which forms a tumbler element. The carrier can be held detained in different angular positions. Each of the angular positions incorporates a different magnetic coding of the lock. This type of recoding is user-unfriendly and impairs the dependability of operation, including security against breaking-in. In this connection there is the danger, in particular, that an unauthorized person will effect the turning of the carrier by means of a tool and that the lock can no longer be opened by the key which was previously intended for it.

Considerable difficulties can arise if it is not known, in particular upon the existence of several turnable carriers, into what position they have been turned. These possibilities by themselves make it necessary that the possibility of resetting the lock not be made known, insofar as possible, to all users of the lock and that this knowledge and the corresponding tool remain restricted to certain trusted individuals. Accordingly, the recoding of the lock can also not be included in the continuous, normal course of operation as is, for instance, frequently the case in hotel locking systems which operate purely electrically. In those locks which operate with pure magnetic-track coding and on an electronic basis, in order to increase the security of electronic basis and of operation, recoding has been proposed in the manner that a key dispensing device which is present at the hotel reception desk issue a different key in a certain updating program or the like for, in each case, the next-following guest in such a manner that the hotel door lock, after the use of this new guest key, no longer accepts the preceding guest key as a suitable key (cf. Federal Republic of Germany Patent 24 01 602). If, in this connection, wires from the dispensing computer at the reception desk up to each hotel door lock are to be avoided, the hotel door lock must have a corresponding updating program stored in it. This greatly complicates such a lock system. That version, on the other hand, also requires sources of voltage in each individual hotel door lock and includes the disadvantage that disturbances in operation occur when a guest does not enter his room at all with a newly issued key and leaves the hotel without entering the room, in which case the next following guest receives a key which the room door lock cannot accept since the intermediate guest key never became known to it.

In the case of structural forms of locks operating on the basis of mechanical release of the lock and which can be closed with multi-bit keys, a recoding of the closing code of the tumblers is known in the form that upon operation with the first key a barrier must, in addition, be released manually, it eliminating a basic position of the tumblers which is secured by combination engagement, whereupon, upon operating the lock by means of a successor key, the setting of the tumblers to the closing code of the successor key is effected, including the restoring of the combination engagement. These structural forms also have the same disadvantages from the standpoint of operation. If the key is lost, the only thing possible is to destroy the lock.

It is furthermore known from U.S. Pat. No. 3 234 768 to effect a permutation change on cylinder locks. In connection with one of the pin tumblers of this solution, a tumbler member in the form of a ball is provided between core pin and housing pin. At the height at the place of separation between the pin bore and the turning gap of the cylinder core, the closure cylinder housing forms a channel which extends to the outside and the diameter of which is somewhat larger than that of the ball. If this cylinder lock is actuated with a first key, then this key in addition to arranging the other pin tumblers, arranges the special pin tumbler in such a manner that the place of separation between ball and housing pin lies at the height of the core turning gap. If this first key is to be blocked out, this can be done with a successor key, the so-called occupants key. By means of the latter, upon the key insertion movement, in addition to the other pin tumblers, the special tumbler is controlled in such a manner that the place of separation between core pin and ball is located at the height of the core turning gap. Upon the following closure turning, the ball passes outward through the channel. The special pin tumbler then operates in the same way as the others. A closing action can no longer be effected by means of the first key. Furthermore no further permutation change can be obtained unless the ball is introduced again in some way.

SUMMARY OF THE INVENTION

The object of the present invention is so to develop a closure system of the type set forth in the introductory paragraph above in which, dispensing with actuation by a tool or hand knob, it is possible to effect a recoding which, in particular, as a result of the use of a compulsory sequence in the use of the keys, can, with the least possible expense, also be included in the normal operating use of the closure system and therefore, for instance, in the case of hotel closure systems, be placed also within the field of competence of the guests. According to the invention the displacement of the tumbler member by means of the corresponding successor key is effected in the manner that the successor key is divided into a first region (e.g. A) which is associated exclusively with the closure code of the tumblers and a second, supplementation region (e.g. E) which enters into action when the first region agrees with the closure code of the tumblers, the supplementation region shifting the tumbler element into the position actuated by the supplementation region of the next successor key.

As a result of this there is created a closure system in which the successor key in each case effects the recoding in positive manner, i.e. solely by its use. The lock housing therefore need no longer have, for instance, any special additional tool entrance openings Safety against breaking-in and misuse is improved since the recoding cannot be effected by just any insertion tool. The possessor of the key therefore need not even know that he has received a key which effects the resetting. With this key he actuates the lock in customary manner without knowing that a recoding is effected upon this actuation. The predecessor key is blocked out; a resetting to its code by using it is therefore not possible.

One can therefore, in this way, with relatively minimum expense, arrive at a possibility of recoding which permits the optimal use of such locks in hotel closure systems. In each case, the next guest decodes his hotel room lock by the first opening actuation with the key which he has received so that the key of the previous hotel room guest can no longer close the lock. The successor key is from then on the normal key. There is also a necessary sequence in the use of the successor keys. The skipping over of the successor key is not possible. This has the result in practice that the successor keys can be inserted only in sequence, one after the other, which considerably reduces misuse. If for instance, a successor key is skipped over, then the corresponding tumbler member can not be engaged by the supplementation region of the previously issued successor key. The tumbler member namely, has not yet been shifted in position by the proper successor key. This system is furthermore suitable in connection with cylinder locks. After a change in the position, the tumbler member is still always in a position which can be engaged by the successor key. The tumbler member, in contradistinction to the cylinder locks of the prior art is therefore, after use of the successor key, still included in the permutation of the lock. In this way, there is advantageously obtained a rhythmic recurrence, a so-called repeat, in the change in position of the tumbler members, both in the case of locks with mechanical coding and in the case of locks with magnetic coding.

BRIEF DESCRIPTION OF THE DRAWINGS

Other advantages and details will become evident from the following description of various embodiments of the invention which are shown in the drawing, in which:

FIGS. 28 to 39 show a structural form which also operates mechanically and has a closure cylinder.

DETAILED DESCRIPTION OF THE PREFERRED EMBODIMENTS

The description is divided into three sections corresponding to the three categories of structural form. The first category of structural form is now described.

Figure 1:
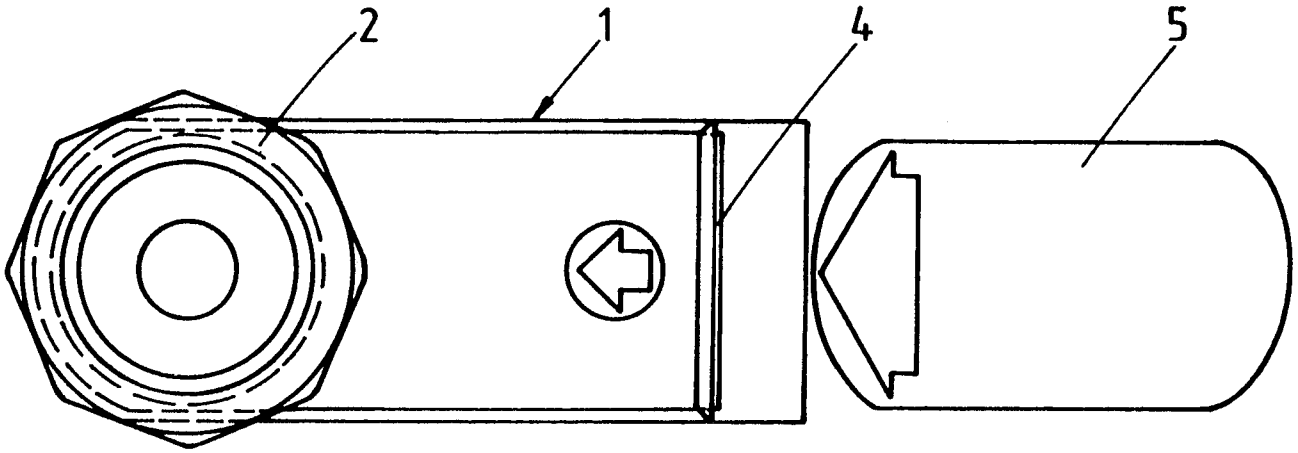
FIGS. 1 to 17 show mechanically operating structural forms.
Figure 2:
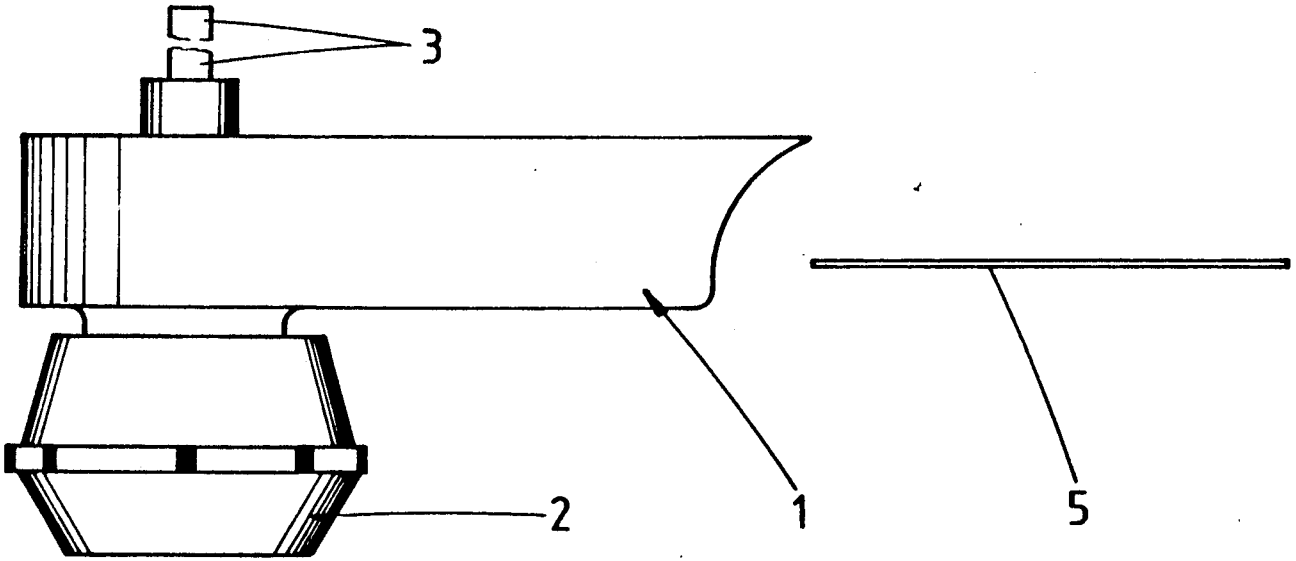
Figure 3:
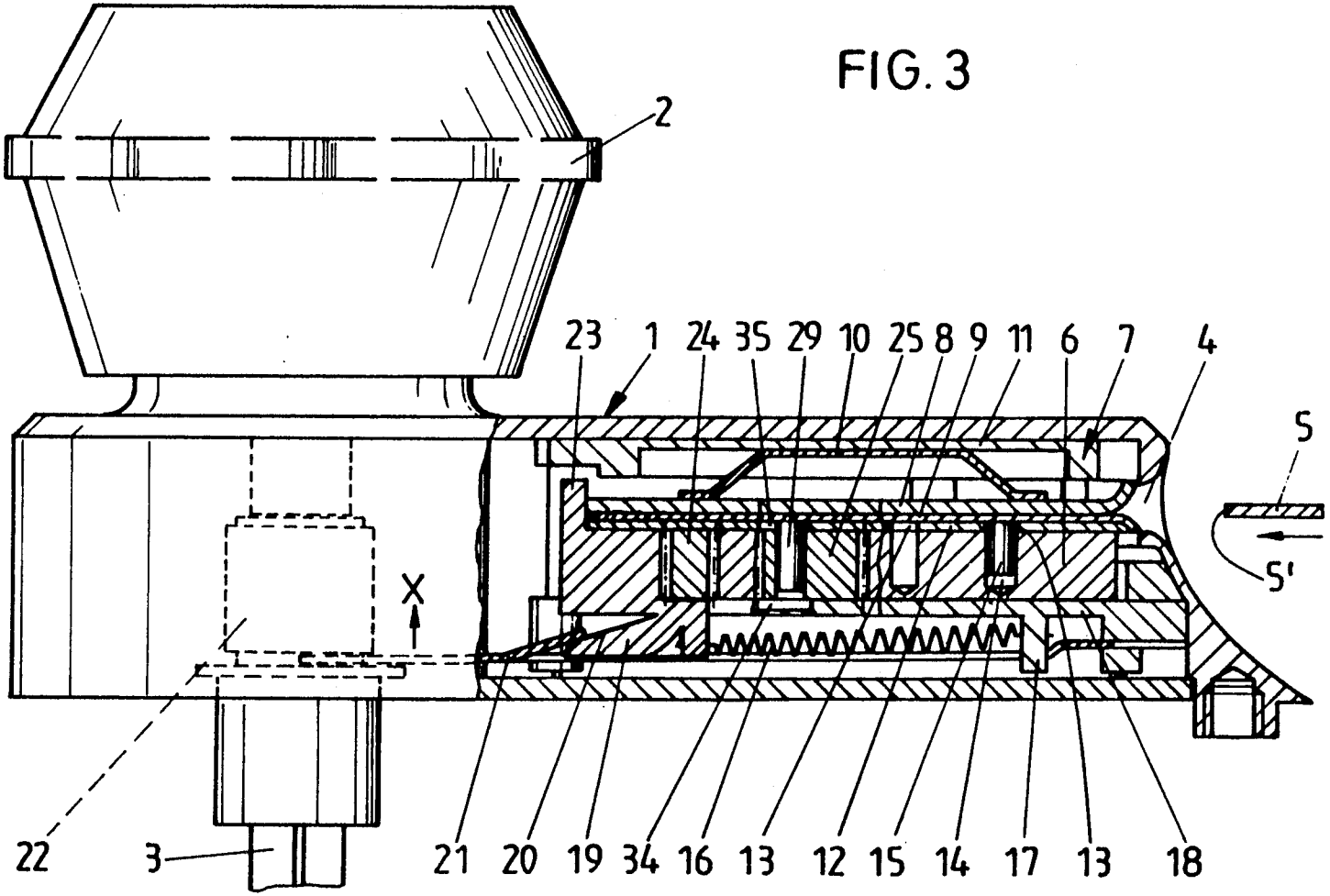
Figure 4:
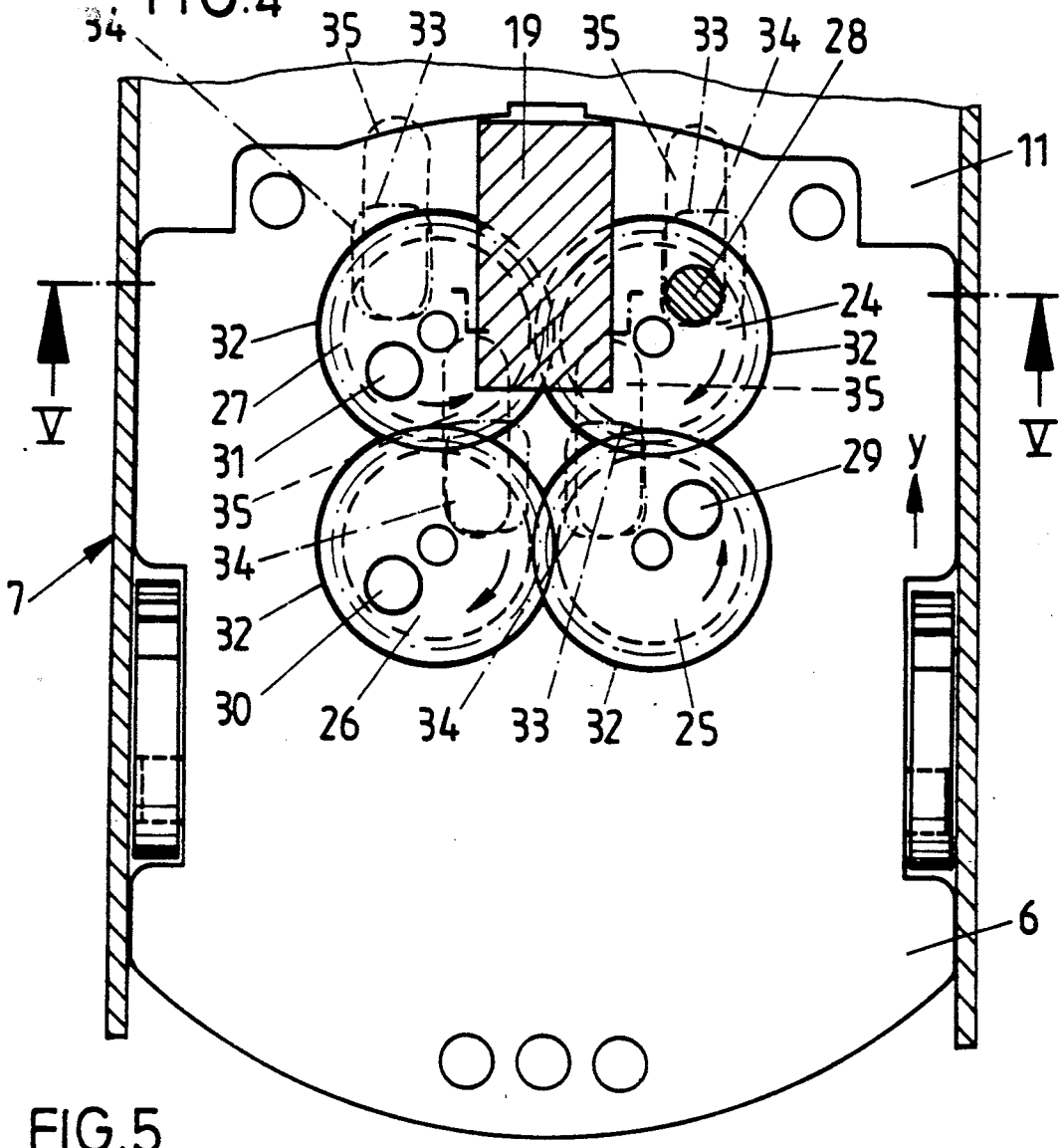
Figure 5:
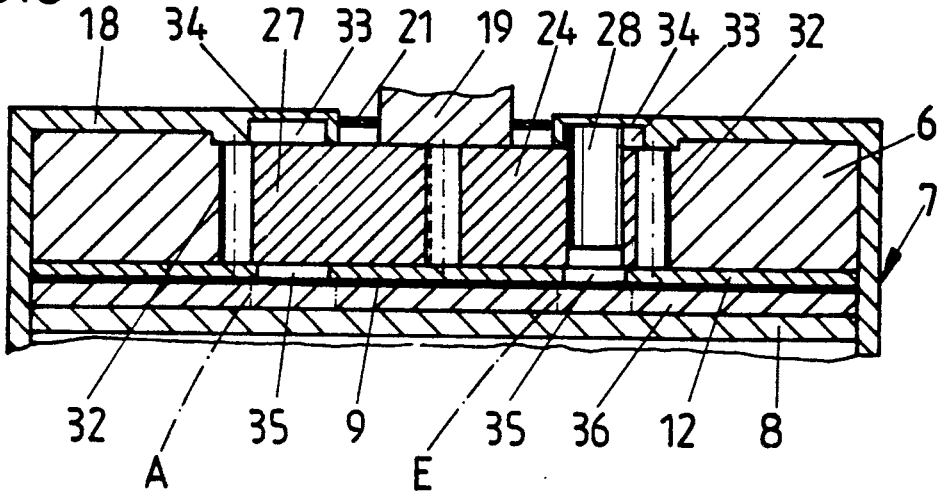
Figure 6:
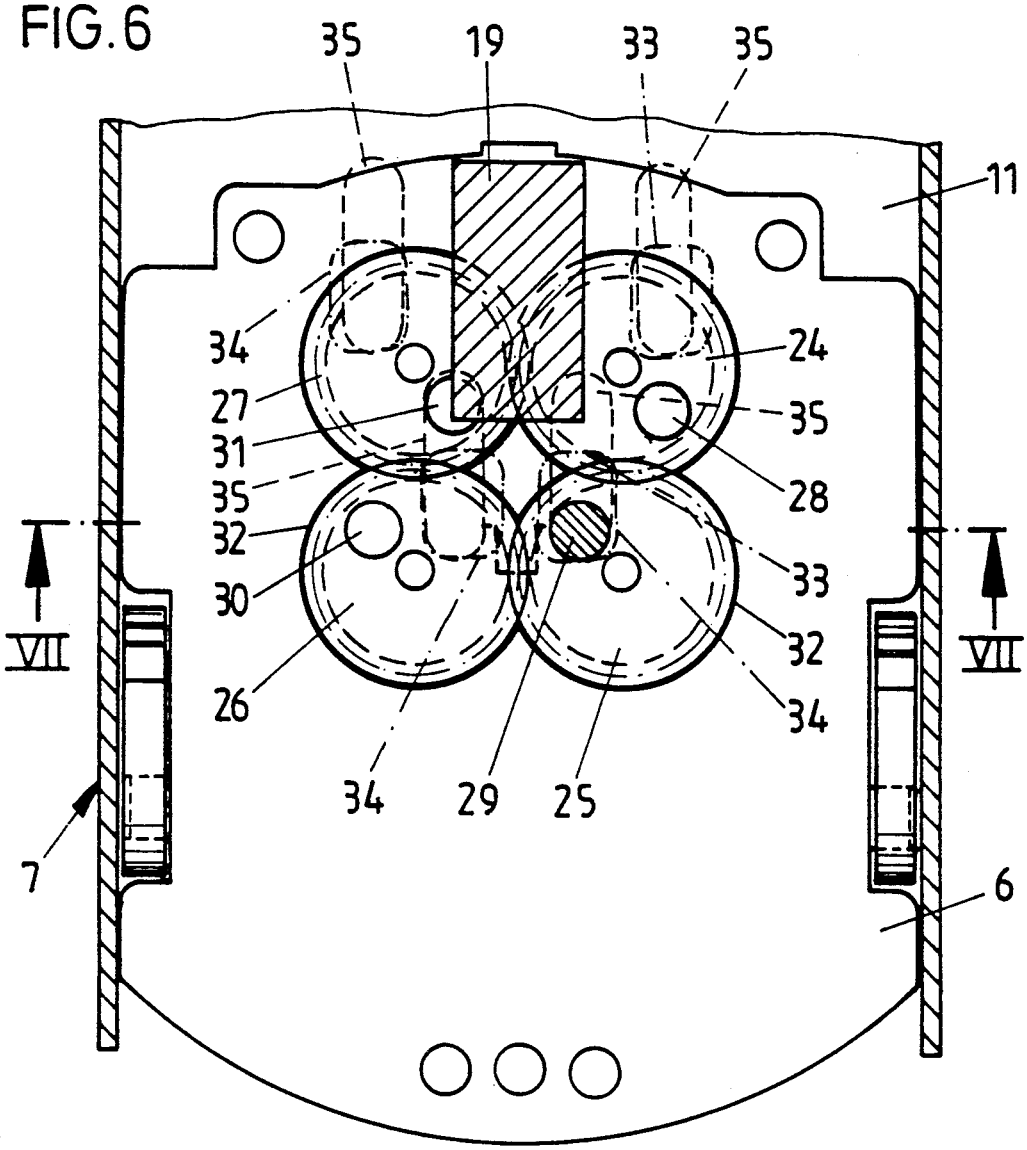
Figure 7:
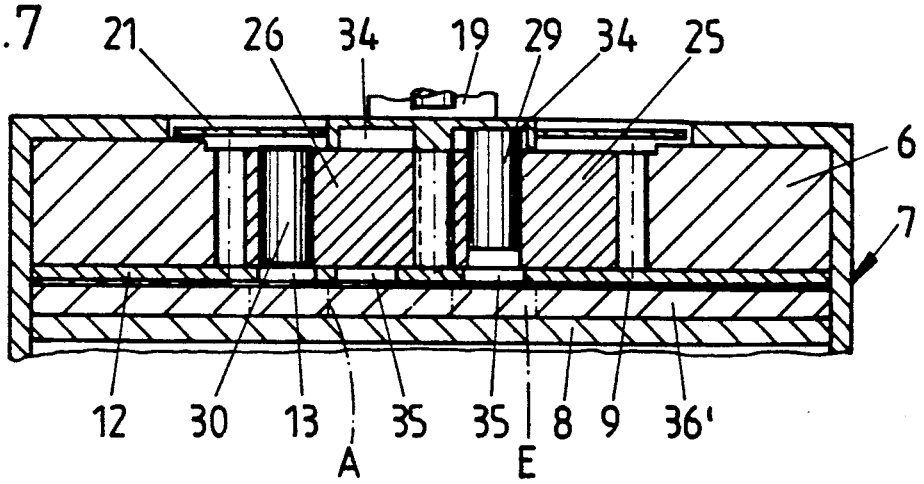
Figure 8:
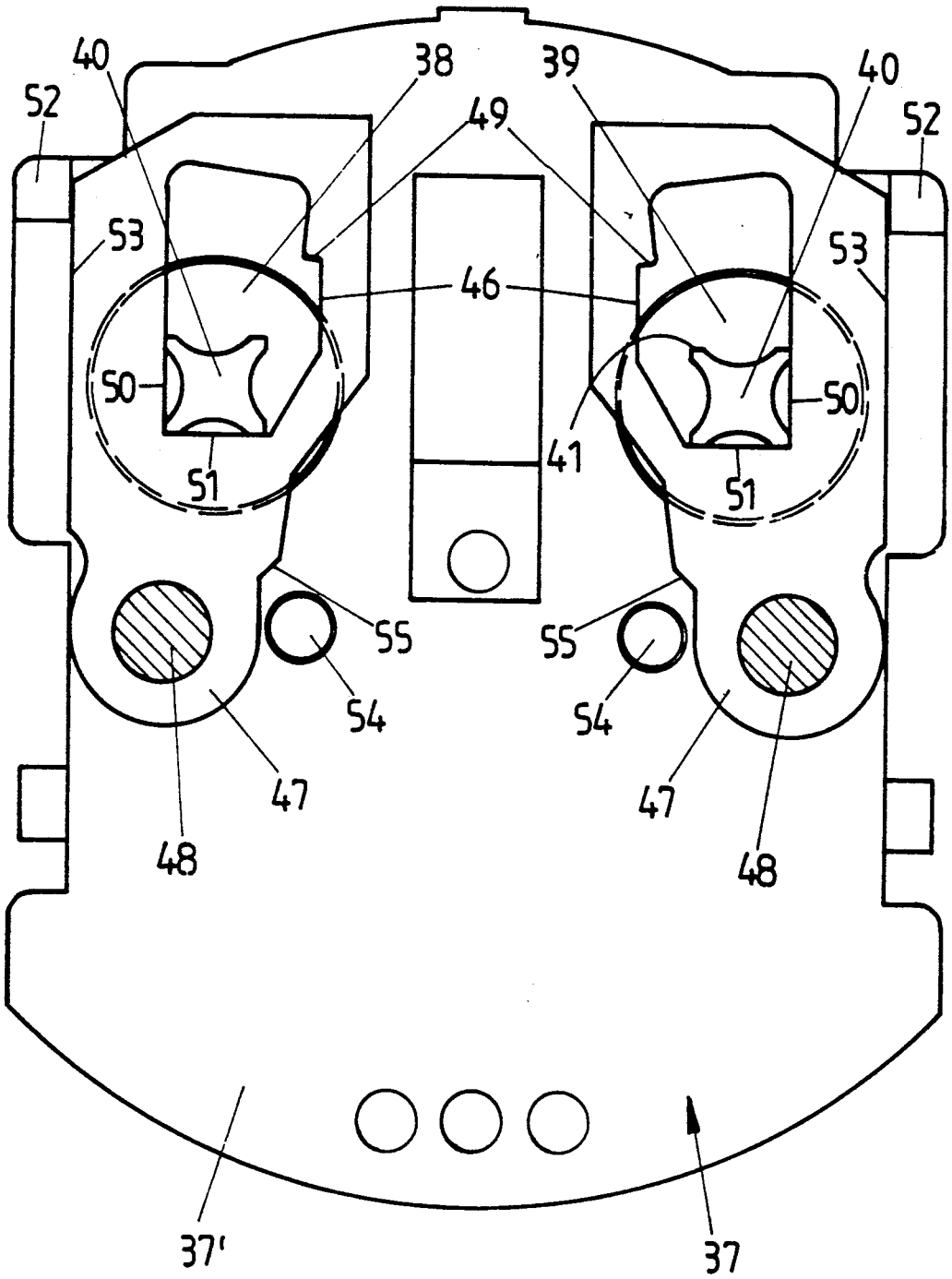
Figure 9:
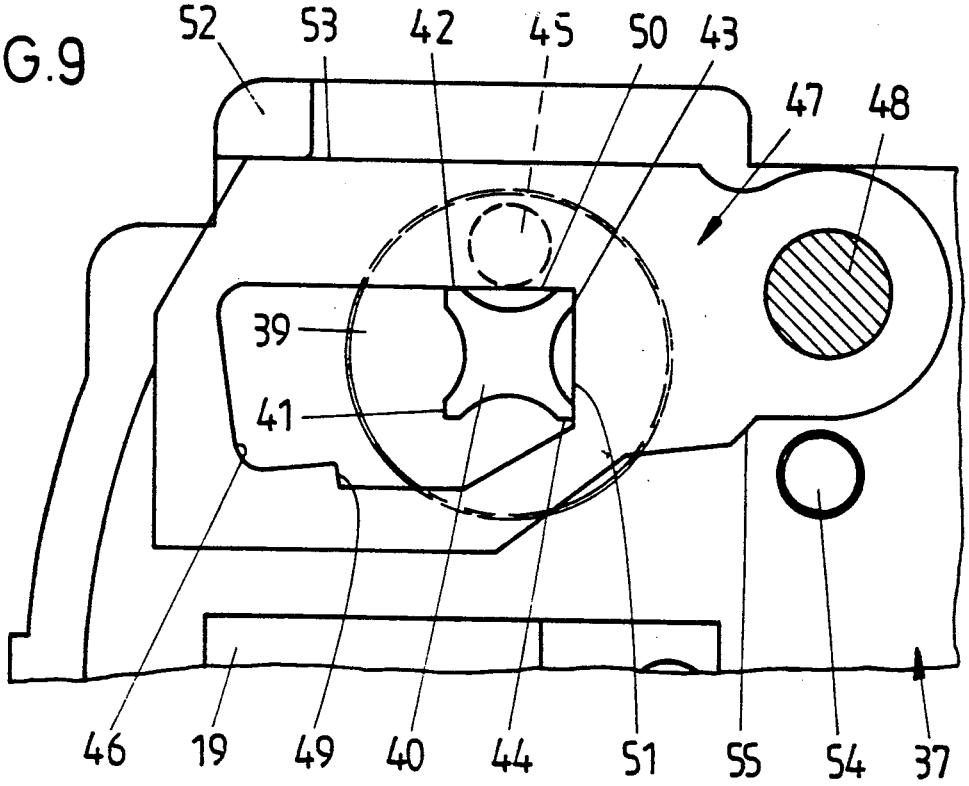
Figure 10:
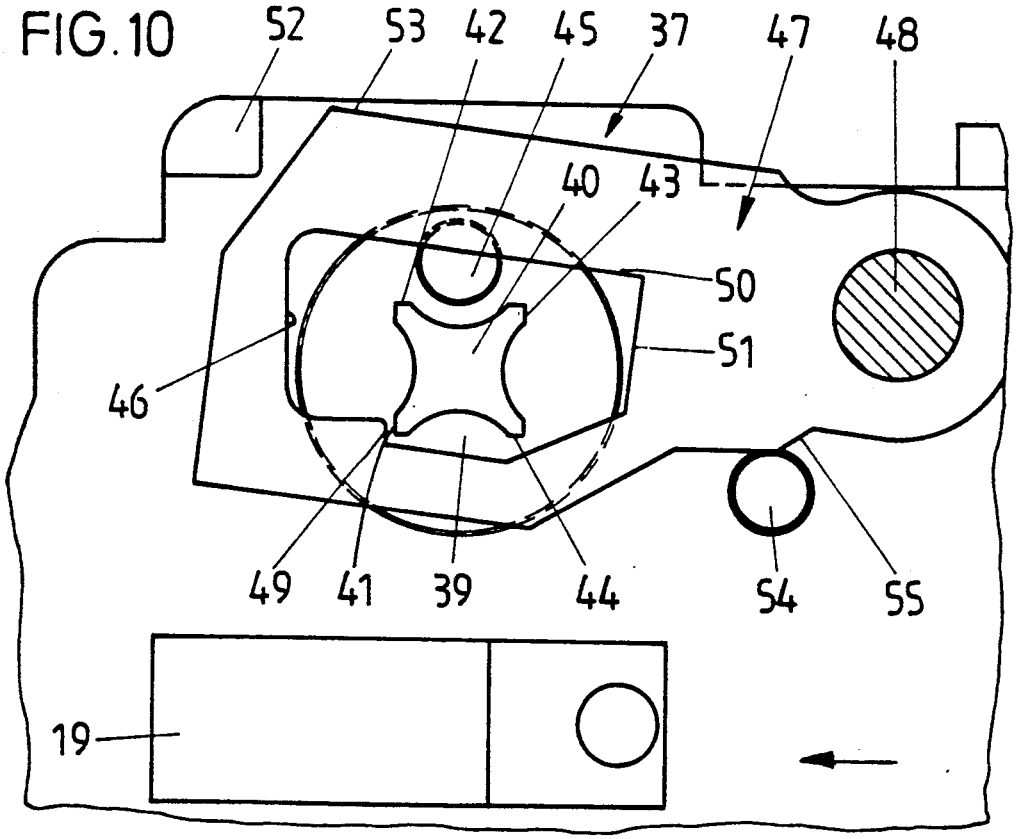
Figure 11:
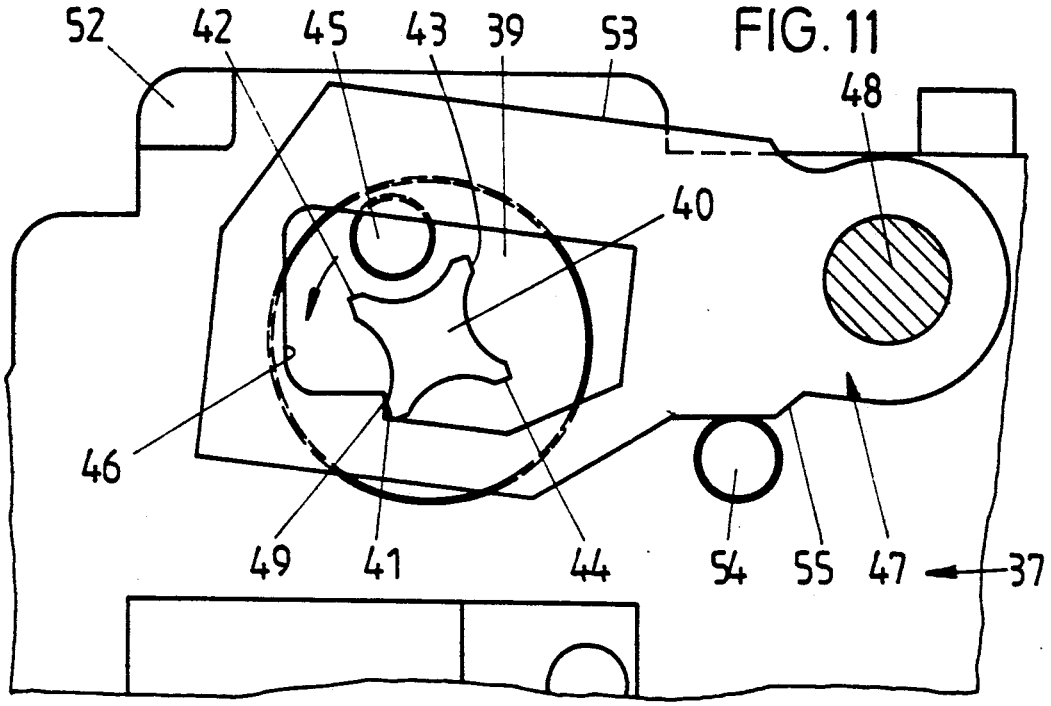
Figure 12:
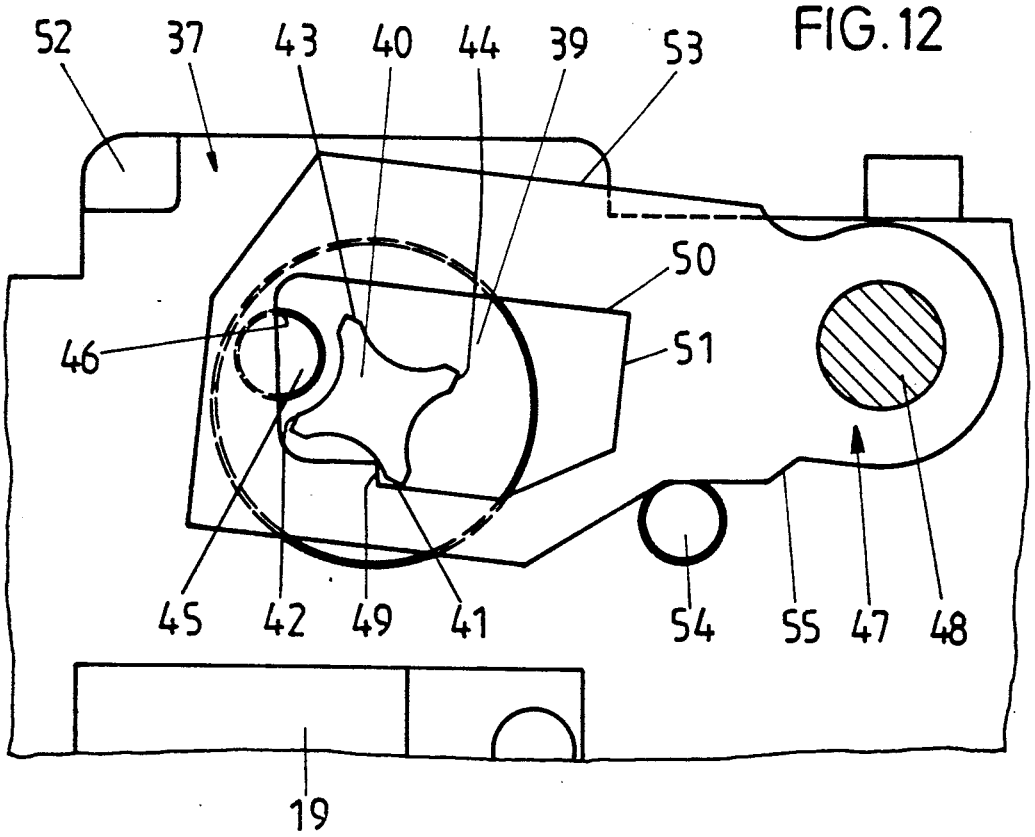
Figure 13:
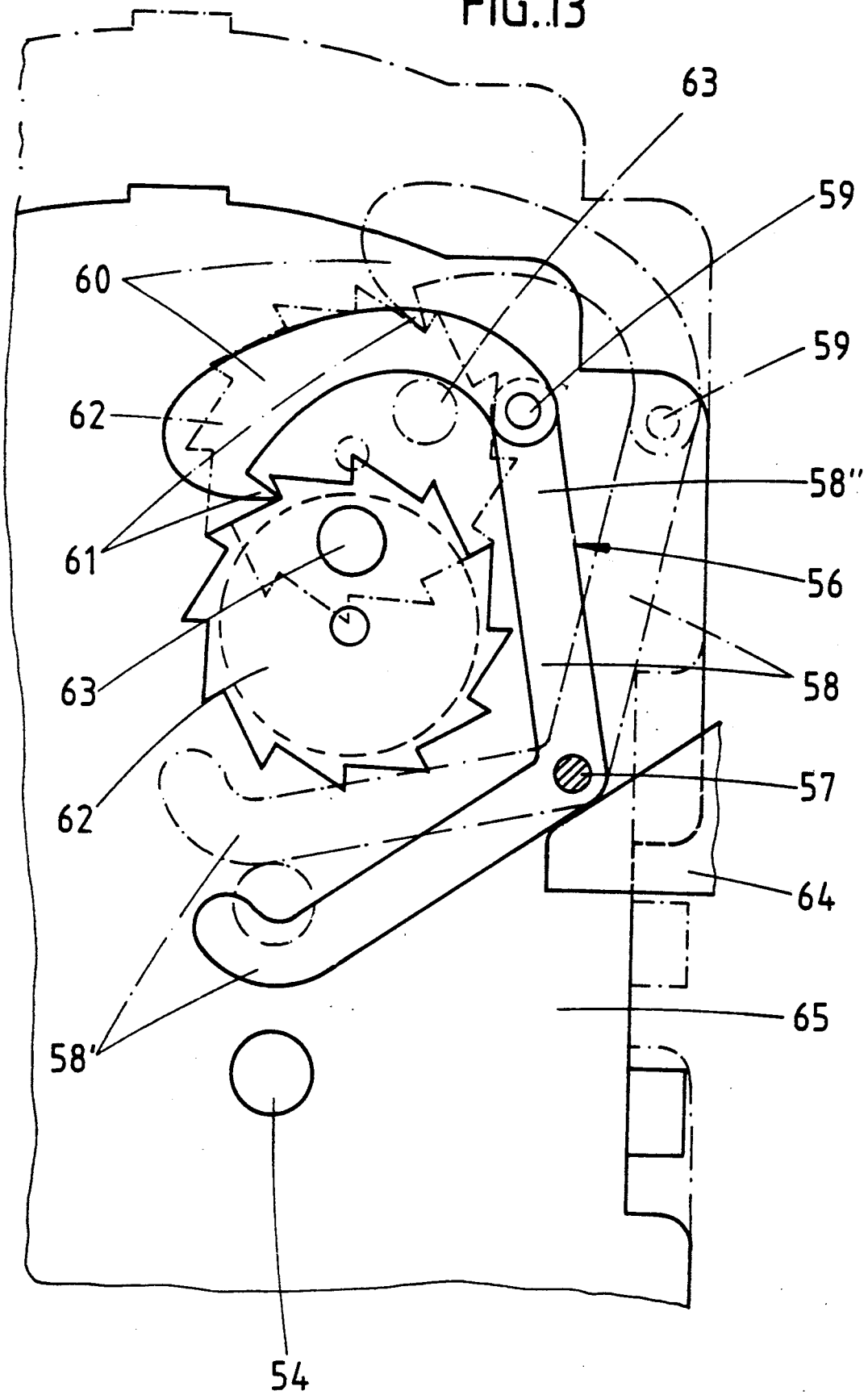
Figure 14:
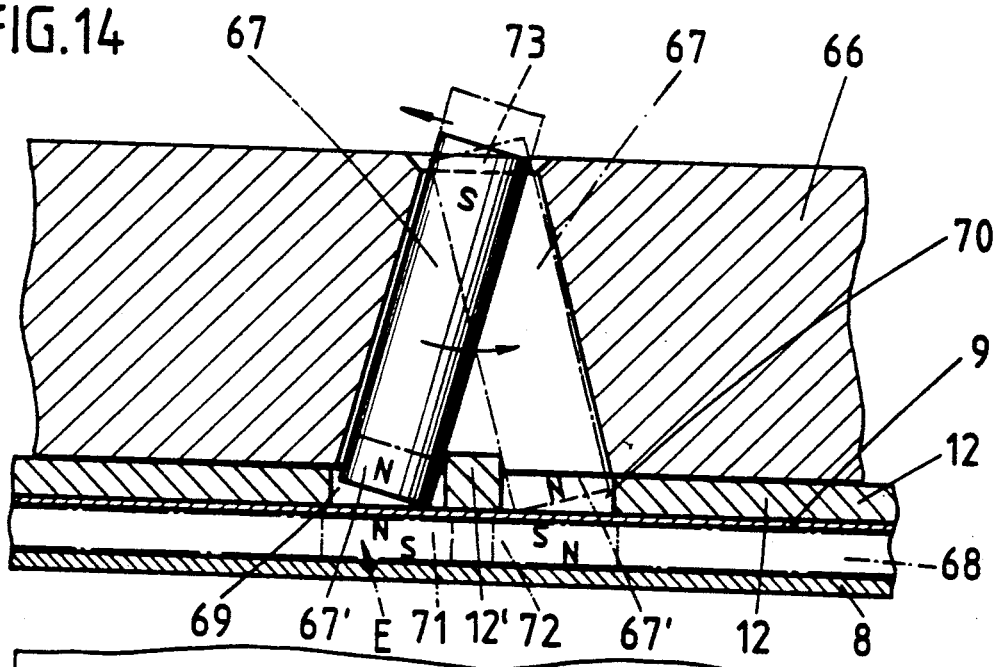
Figure 15:
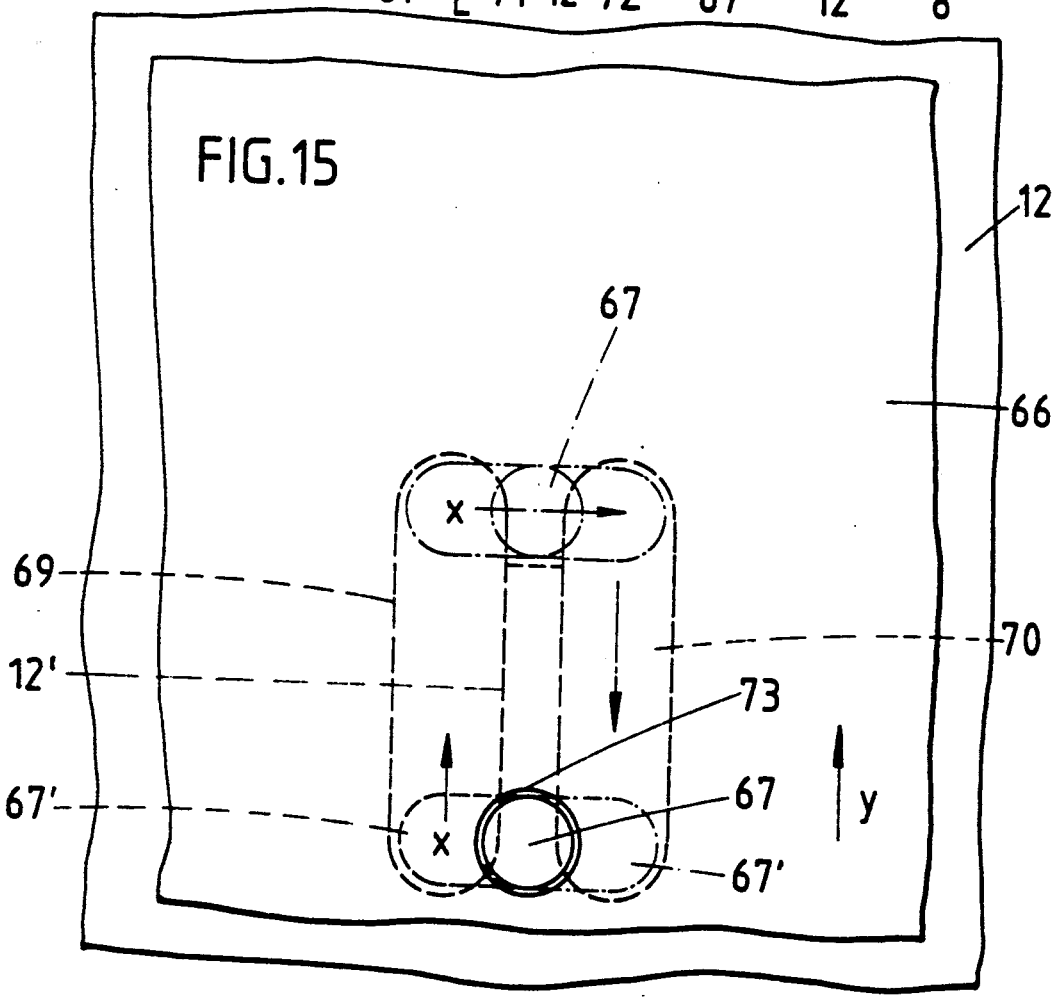
Figure 16:
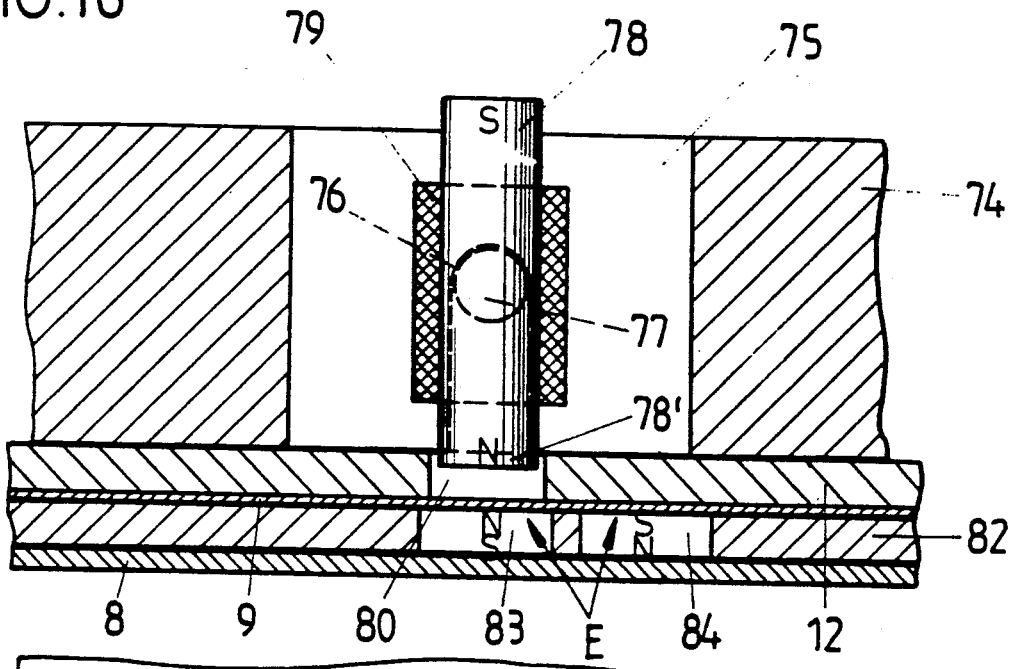
Figure 17:
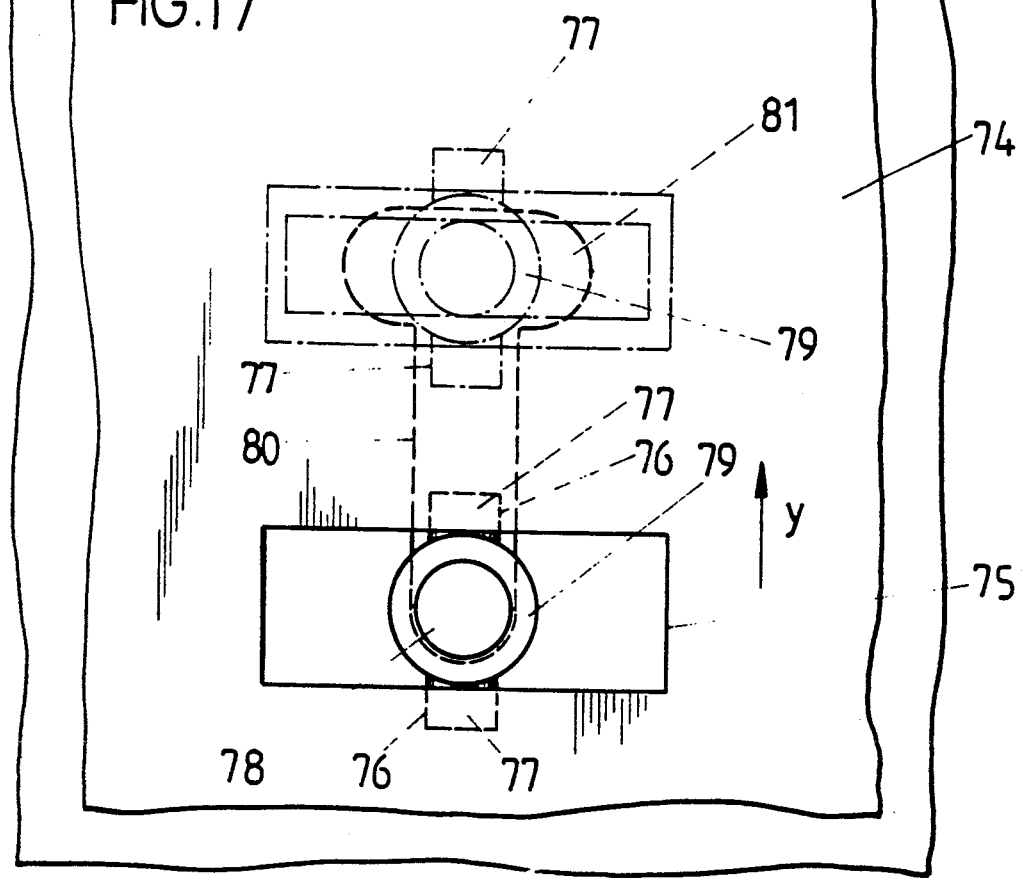

In detail,

FIG. 1 shows a lock adapted to be fastened to a door and having a key in the form of a card, FIG. 2 is a top view of FIG. 1, FIG. 3 shows the lock of the first embodiment in a larger view, partially in longitudinal section and partially in elevation, before the insertion of the key, FIG. 4 is a section at the level of one wide side of the pusher, showing the carriers which are in toothed engagement with each other, FIG. 5 is a section along the line V—V of FIG. 4, FIG. 6 is a showing corresponding to FIG. 4 but with the carriers turned forward one step after displacement of the pusher by means of a command key, FIG. 7 is a section along the line VII—VII in FIG. 6, FIG. 8 is a top view of the pusher in accordance with the second embodiment, shown on a larger scale, FIG. 9 is a greatly enlarged detail view of a portion of the pusher in the region of the carrier and of the control member associated with it, arranged on the housing side, FIG. 10 is an intermediate position upon the forward displacement of the pusher, with the control member swung by the control magnet, FIG. 11 shows the following intermediate position, indicating the forced turning movement of the carrier, FIG. 12 shows the pusher in the completely advanced position, FIG. 13 is a partial top view of the pusher with carrier and the multi-member pawl turning it, referring to the third embodiment, FIG. 14 is a cross section through the pusher at the height of a permanent magnet which is arranged in the manner of a pendulum, referring to the fourth embodiment, FIG. 15 is a top view of FIG. 14, FIG. 16 is a cross section through the pusher at the height of a permanent magnet which can be displaced by 180° around a transverse axis, and FIG. 17 is a top view of FIG. 16.

In all the magnetically operating embodiments, the lock shown in FIGS. 1 and 2 has an elongated lock housing 1 associated with a door (not shown). At its one end, the housing has a rotatable knob 2 by means of which a latch or bolt can be pulled back if the lock is in locking position.

The knob 2 can be coupled with a push pin 3 of square cross section which is the carrier of an inner knob (not shown) lying on the inside of the door. By means of this knob the latch or bolt (not shown) can be pulled back at any time.

In order to be able to actuate the lock from the outside of the door, the lock housing is provided on the edge side opposite the turn knob 2 with an insertion slot 4 into which a card-shaped key 5 can be inserted. The key 5 is a card provided with magnetic coding which is of sufficient stiffness in order to be able by means of it to displace a pusher 6 which is guided within the lock housing 1.

The pusher 6 is received by an inner housing 7 which is inserted into the lock housing 1 and bears two guide plates 8 and 9 which are arranged parallel to the pusher 6. The guide plate 8 is a plate consisting of ferromagnetic iron while the other guide plate is anti-magnetic. The guide plate 8 is thicker than the guide plate 9 which is adjacent to it, and it is acted on by a leaf spring 10 which, on its part, rests against the bottom 11 of the inner housing 7. Before the insertion of the key 5, the guide plates 8, 9 lie flat against each other. If the key 5 enters between the guide plates 8 and 9, the guide plate 8 moves out, under spring action, in the direction towards the bottom 11.

The antimagnetic guide plate 9, on its part, rests against a blocking plate 12 consisting of non-magnetizable material. In the embodiment shown, brass is used for the blocking plate. In the blocking plate 12 there are, suitably distributed, circular blocking openings 13 which, in the initial position of the pusher 6, correspond to blind holes 14 in the latter. In some of the blind holes, pin-shaped permanent magnets 15 are introduced which, in their turn, are attracted by the guide plate 8 and pass through the blocking openings 13. Depending on their arrangement, the permanent magnets, in this case, act with their south pole or north pole on the guide plate 9. Accordingly, the pusher 6 cannot be displaced. Furthermore, it is under the action of a tension spring 16 which urges it in the direction towards the insertion slot 4. The tension spring 16 is connected at one end to a pin 17 of a cover 18 covering the pusher 6 and on the other end to a control projection 19 extending from the pusher 6. The projection is provided with an oblique surface 20 by means of which, upon forward displacement of the pusher 6, a leaf spring 21 which is fastened to the inner housing 7 at the height of the insertion slot 4 can be shifted in the direction indicated by the arrow X, it carrying along with it a coupling sleeve 22 and thereby bringing the turn knob 2 into a coupling position with the push pin 3, which then permits the door to be opened.

The forward displacement of the pusher 6, however, is possible only after insertion of the proper key 5 which, in the completely inserted position, rests with its edge side 5' against a drive shoulder 23 of the pusher, said shoulder lying towards the inside of the lock. In the key-insertion position, the corresponding permanent magnets 15 are then aligned with correspondingly positioned magnetization regions of the key. In this way, the permanent magnets are repelled in the direction towards the blind holes 14 and accordingly leave the blocking openings 13 of the blocking plate 12.

In order to change the magnetic closing code, the pusher 6 in accordance with the first embodiment has four turnable carriers 24, 25, 26, 27 which are coupled with each other and each of which is provided with a recoding magnet 28, 29, 30, 31 developed as tumbler member. On the outside, the carriers 24 to 27 are provided with a toothing by which they are in toothed engagement with each other. In order to receive the carriers, holes 32 of suitable diameter are provided in the pusher 6. The carriers, each of which is provided with a recoding magnet, are so arranged with respect to each other that the recoding magnets, due to the turning motion of the carriers, move one after the other in each case into the position in front of an obstacle or out of said position. The obstacle 33 is formed by a transverse edge of a longitudinal groove 34 which extends in the direction of displacement y of the pusher 6. Since four recoding magnets or tumbler members are present, four such longitudinal grooves 34 are also provided. They are located in the cover 18 of the inner housing 7 which covers the pusher 6. The two longitudinal grooves 34 which are arranged further inward in the lock have a greater distance from each other than the other two longitudinal grooves 34.

However, of the four recoding magnets 28 to 31, only one in each case acts as true coding magnet or true tumbler member. In accordance with FIGS. 4 and 5, this is the recoding magnet 28. With its end which faces the blocking plate 12, it extends, when the successor key 36 is not inserted, into a longitudinal slot 35 lying in direction of displacement in the blocking plate 12. The other recoding magnets 29, 30, 31 can then extend into corresponding blocking openings 13 of the blocking plate 12 so that they assume in this case a function similar to the permanent magnets.

If the lock is associated, for instance, with a hotel-room door, the guest has a guest key which is comparable to the key 5. With it, all permanent magnets 15 and recoding magnets 29, 30, 31 are so displaced that they come out of engagement with the blocking openings 13. In this way, the pusher 6 can be pushed in the direction of the arrow y, producing a coupling with the turn knob 2. Only the recoding magnet 28 or tumbler member is not shifted in this case. Movement of the pusher is nevertheless possible due to the longitudinal slot 35 in the blocking plate 12.

If another guest moves into the hotel room which was previously used, then a recoding of the lock is effected prior to this by the hotel, using the command key shown in FIG. 5, which serves as successor key. It has a first region E which causes the resetting. The corresponding regions are shown in dash-dot line in FIG. 5. By means of the first region A all permanent magnets, and by means of the supplementary region E also the recoding magnet 28 or tumbler member, are brought out of engagement with the blocking plate 12. The recoding magnet 28 therefore extends into the longitudinal groove 34. Upon the following displacement of the pusher in the direction indicated by the arrow y by means of the successor key 36, the corresponding end of the recoding magnet 28 then comes against the obstacle 33 of the longitudinal groove 34 and thereby forces the turning of the carrier 24 and of the other carriers meshing with it in the direction shown by the arrow. After a displacement of the pusher 6, the position shown in FIGS. 6 and 7 is reached. The previous recoding magnet 28 has left its position of alignment with the longitudinal groove 34 while the recoding magnet 29 of the carrier 25 has come into the recoding position. It is therefore no longer possible to effect a displacement of the pusher by means of the previous guest key because the recoding magnets or tumbler members have changed position. Furthermore, the new guest must be issued a modified guest key by means of which he can suitably displace all magnet except for the recoding magnets 29. By means of a successor key 36 of the hotel, which also has the regions A and E, also this recoding can be changed again, in which case another recoding pin then comes into the corresponding recoding position; see FIG. 7.

Variations with respect to this embodiment are possible in the manner that the number of carriers is changed. It is also possible to provide each carrier with more than one recoding magnet.

In accordance with the second embodiment, shown in FIGS. 8 to 12, the pusher is designated by the numeral 37. Its construction corresponds to the pusher 6. One change is that the pusher now receives two carriers 38 and 39 which lie alongside each other at the same height. On its end facing away from the insertion slot, each carrier 38, 39 is continued in a switch cam 40 which extends over the corresponding wide surface 37' of the pusher and which forms switch cam edges 41, 42, 43, 44 which, in their turn, are arranged in the manner of a Maltese cross. Each carrier 38, 39 also receives a recoding magnet 45 which is similar to a tumbler member and cooperates with a corresponding blocking opening in the blocking plate 12.

The Maltese-cross-like switch cam 40 passes through an inner opening 46 in a control member 47 which is fixed in position. The mounting pin 48 thereof is seated in suitable manner on the cover 18 of the inner housing 7. The mounting place of the single-arm control member 47 faces, in this connection, the direction of insertion of the key. By an edge which lies approximately perpendicular to the direction of displacement of the pusher 37, the inner opening 46 forms an obstacle 49. The inner opening 46 is so developed that, in the starting position of the pusher, three corners of the Maltese cross form stop surfaces for two inner opening walls 50, 51 which are at right angles to each other. Furthermore, there is also provided on this pusher 37 a stop 52 against which the rear edge 53 of the control member 47 comes. In this way, the latter is secured against turning. Upon displacement of the pusher, this securing is only eliminated when the control magnet 54 has passed, for instance, through the idle stroke. The stop 52 together with the edge 53 also effects the last part of the remaining rotation of the Maltese cross into the basic position shown in FIG. 8 upon the return displacement of the pusher.

At the height of the mounting place of the control member 47, a suitably polarized control magnet 54 is guided in the pusher 37. Upon the use of a normal key, for instance a guest key, this control magnet 54 is not displaced since the end of the control magnet 54 which faces the blocking plate extends in a longitudinal slot in the blocking plate 12.

If a recoding of the lock is to take place, a successor key is to be used as in the case of the preceding embodiment. By the corresponding regions thereof the permanent magnets, the tumbler-member-like recoding magnet 45 and the control magnet 54 are brought out of engagement with the blocking plate. After passing through a small idle stroke, the end of the control magnet 54 which extends beyond the wide surface 37' of the pusher strikes a control flank 55 of the control member 47 and lifts the latter into the position shown in FIG. 10. In this way, the result is obtained that the obstacle 49 then lies at the height of the switch-cam edge 41. Upon further displacement of the pusher 37 the position shown in FIG. 11 is reached. From that Figure it can be noted that the carrier 39 is turned by the obstacle 49 in the direction indicated by the arrow. After complete forward displacement of the pusher 37, the position shown in FIG. 12 is then present. In this position, the carrier 39 and the recoding magnet 45 accordingly assume a different position of angular rotation. If the pusher 37 is now brought again into its starting position, the aforementioned remaining rotation of the carrier 39 takes place, so that the recoding magnet 45 is then aligned with another blocking opening in the blocking plate. The guest key which was previously used then no longer arranges this relocated recoding magnet and the pusher 37, accordingly, cannot be displaced forward in order to open the lock. If the hotel room door is locked, then the next guest is to be issued a correspondingly coded key.

In the case of the modified third embodiment shown in FIG. 13, the control member 56 is developed in the manner of a multi-member pawl. It has an angle lever 58 which is mounted on the housing side by the pin 57. Its one lever arm 58' lies in the region of movement of a control magnet 54. Here also there is a short idle stroke between the control magnet 54 and the lever arm 58'. The other lever arm 58'' bears, by means of a pivot pin 59, a pawl lever 60 the locking tooth 61 of which, forming an obstacle, cooperates with the teeth of the carrier 62 developed as a ratchet wheel. This carrier receives a recoding magnet 63 representing the tumbler member. A spring (not shown) urges the angle lever 58 in counterclockwise direction. Its initial position is limited by a stop 64 on the housing side. The pawl lever 60 is also associated with a spring (not shown) which is seated, for instance, on the pivot pin 59 and urges the pawl lever 60 into toothed engagement with the carrier 62.

If the normal key is used, the permanent magnets of the pusher 65 and the holding magnet 63 are brought out of engagement with the blocking plate 12. The control magnet 54 passes, in this connection, through a longitudinal slot in the blocking plate 12 and accordingly does not exert any blocking function.

The change in the closing code is effected in this third embodiment also by means of a corresponding successor key the regions of which displace, in addition to the other magnet pins, also the control magnet 54 and lift it out of the blocking plate. The end thereof which protrudes beyond the wide surface of the pusher 65 thus lies at the height of the lever arm 58' of the control member 56. During the forward movement of the pusher 65, the control magnet 54, after an idle stroke, acts on the lever arm 58 and swings the angle lever 56, the carrier 62, which is mounted in the pusher 65, being turned further as a result of further forward displacement of the pusher 65 and via the pawl lever 60. The recoding magnet 63 is thereby imparted by displacement a different position with respect to the pusher 65. In this position, it is aligned, when the pusher 65 has been displaced backwards, with a blocking opening of the blocking plate 12, so that the previously used key no longer locks. A new key must then, in the case of a lock for a hotel room door, be turned over to the new guest. In this embodiment two similarly shaped carriers 62 with blocking member 56 can also be associated with the pusher 65. A modification of this embodiment could be effected in the manner that instead of the pawl lever 60 an escapement is provided, as in the case of a clockwork. A clock spring which can be wound up is then associated as force storage means with the carrier or its shaft. The lever arm 58 is not necessary in this embodiment. Via the control magnet 54, the escapement, upon the forward displacement of the pusher receives the command to permit the carrier to turn further by one step, which force then results from the clock spring.

In accordance with the fourth embodiment, shown in FIGS. 14 and 15, the pusher is provided with the reference number 66. At least one of the permanent magnets 67 borne by it is guided, by the end thereof facing the blocking plate 12, in a blocking-plate longitudinal-slot opening 69. Parallel to this there extends another blocking-plate longitudinal-slot opening 70. With regard to the permanent magnet 67, it may be a control magnet for a previously described control member. In order to change the closing code, the following guest receives a successor key 68, shown dash-dot line in FIG. 14, which has two adjacent magnetic zones 71, 72 for the permanent magnet 67. These zones form the supplementation region E which effects the resetting. The arranging of the other permanent magnets (not shown) is effected by a first region which is associated with the closing code. The zone 71 is so polarized that it acts in repulsion after the pushing in of the successor key 68. In this way, the permanent magnet or control magnet 67 is pushed into the position shown in dash-dot line in FIG. 14. By the displacement then of the key with the pusher 66, the control member lying in the path of the control magnet 67 is acted upon. After complete forward advance of the pusher, the position shown in dash-dot line in FIG. 15 is reached. In this position there takes place a pendulum displacement of the permanent magnet 67 into the other pendulum position, caused by the magnetic zone 72 of opposite polarity. In order to permit the pendulum-like movement of the permanent magnet 67, the end of the receiving opening 73 which faces away from the key is circular while the opposite end is oval. The longitudinal dimension of this oval is located transverse to the direction of displacement y of the pusher 66. In order that the permanent magnet 67 does not swing prematurely, the blocking plate 12 is provided between the longitudinal slot openings with a thickening, designated 12', in front of which the lower end of the permanent magnet comes upon an attempted displacement. The shifted end 67' is pulled through zone 72 into the adjacent locking-plate longitudinal-slot opening 70 and remains there even upon the further closing actuation by this successor key 68. The key previously used, on the other hand, cannot effect any displacement of the pusher 66. A further resetting can only be caused by a successor key which is issued again and which forms correspondingly magnetized regions.

A modification is possible to the effect that, instead of the control-plate longitudinal-slot opening 69 a circular locking-plate blocking opening is selected. The permanent magnet 67 then acts like the other permanent magnets. After the return of the pusher into its initial position, it always returns to the blocking-plate blocking opening. For the recoding, a successor key is then used which corresponds to the key 68. This means that the pendulum movement takes place in the forward displaced position of the pusher, whereupon the key magnetization or the magnetic zone 72 pulls the shifted end 67' into the blocking-plate longitudinal-slot opening 70. Such an embodiment is then independent of a control function for a carrier.

The fifth embodiment can be noted from FIGS. 16 and 17. The pusher 74 is provided with an elongated recess 75 which extends transverse to its direction of displacement. From the side of the pusher facing the locking plate 12 there extend centrally two mounting recesses 76 which are opposite each other and into which mounting pins 77 extend. These pins are part of a cylindrical sleeve of plastic which surrounds a permanent magnet 78. When the key is not introduced, the polarized end 78' of the permanent magnet 78 which faces the blocking plate 12 is pulled into a blocking-plate longitudinal-slot opening 80 lying in the direction of displacement of the pusher 74, up to the guide plate 9. The blocking-plate longitudinal-slot opening 80 widens in T-shape at the end opposite the insertion slot 4, forming a transverse slot 81.

If a successor key 82 is now inserted the supplementary region E of which causes the resetting has two adjacent zones 83, 84 which are of opposite magnetic polarity, permanent magnet 78 is acted on in repulsion by the zone 83. It thus passes into the position shown in FIG. 16 in which the end 78' facing the key still remains within the longitudinal slot 80. This is obtained in the manner that the mounting recesses 76 limit the movement of the permanent magnet 78. During the forward displacement, the end of the magnet pin which extends beyond the corresponding wide surface of the pusher can serve to control a control member which effects a recoding of a carrier-side coding pin. The permanent magnet 78 thus serves as control magnet. As soon as the permanent magnet or control magnet 78 reaches the transverse slot 81, it swings 180° since it is exposed to the force of attraction of the magnetic zone 84, and it is pulled up into the longitudinal slot 80. Further, use of the successor key 82 then does not lead to any controlling of the permanent magnet 78 and thus to any recoding. This must then again be effected by means of another key in which the magnetic regions are suitably polarized.

If the permanent magnet 78 is not used as control magnet and only one blocking-plate blocking-opening is provided for it, an alternate possibility of closing can be obtained by means of corresponding keys. This means that after locking by means of the one key, locking is possible only by means of another key. Repeated successive locking by means of one key can then no longer be effected A variant could be obtained in the manner that the key is imparted an additional coding Upon the insertion of the key, the evaluation of this additional coding takes place. If the key has the correct coding then an obstacle by which a recoding is effected is brought into the position of action, whether it be a displacement of a permanent magnet or a displacement of a recoding magnet held by a carrier.

The locking-plate openings and locking-plate longitudinal slots may possibly also be provided in an additional plate. The force accumulator can be so coupled with the pusher that it is wound up to a certain amount by each displacement of the pusher. Since as a result of the more frequent normal key actuation, the pusher is actuated more frequently without a resetting displacement, it results statistically that it never completely discharged.

The structural form operating with a multi-bit key shows in

Figure 18:
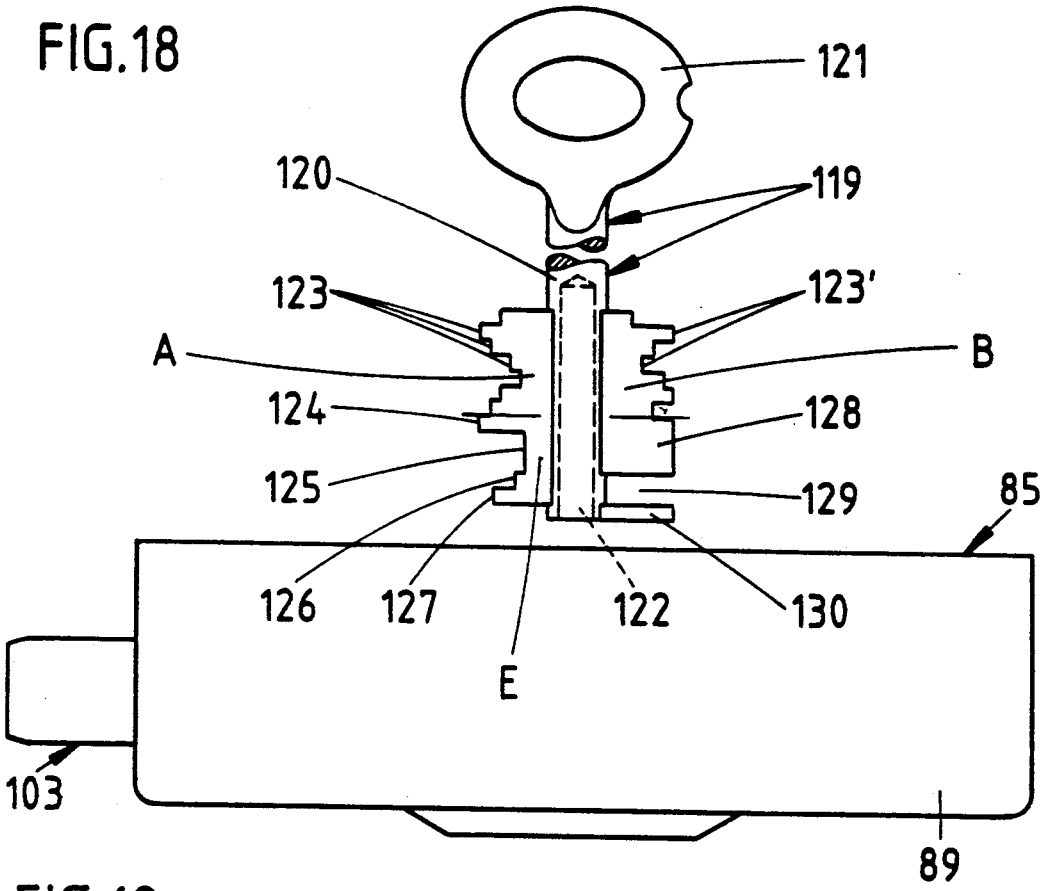
FIGS. 18 to 27 show a structural form which cooperates with a multi-bit key.
Figure 19:
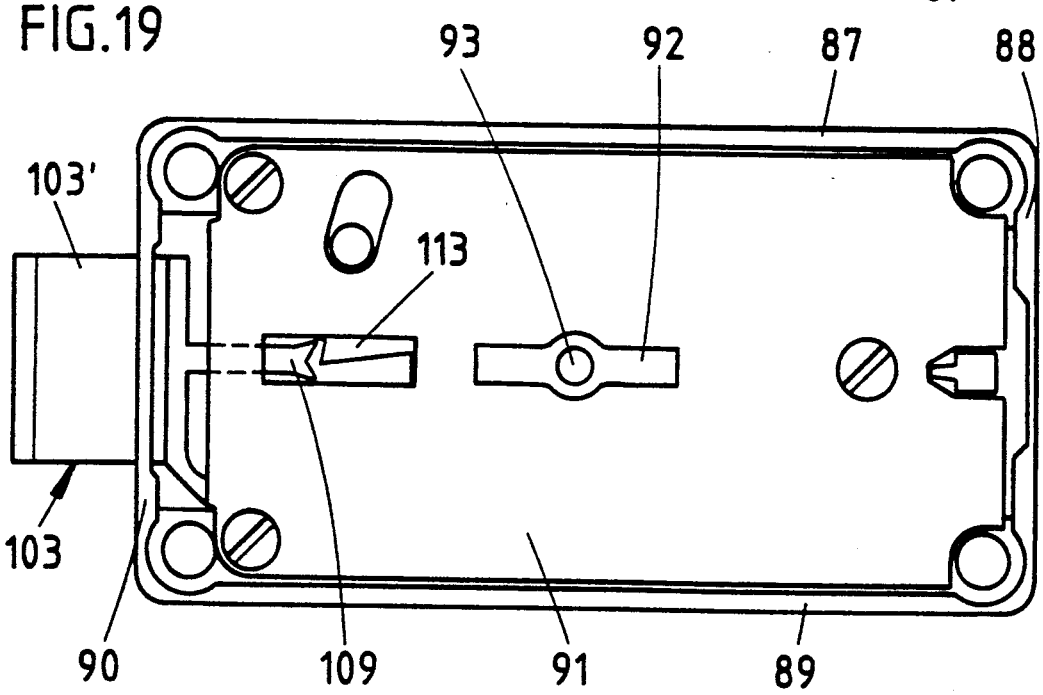
Figures 20, 21:
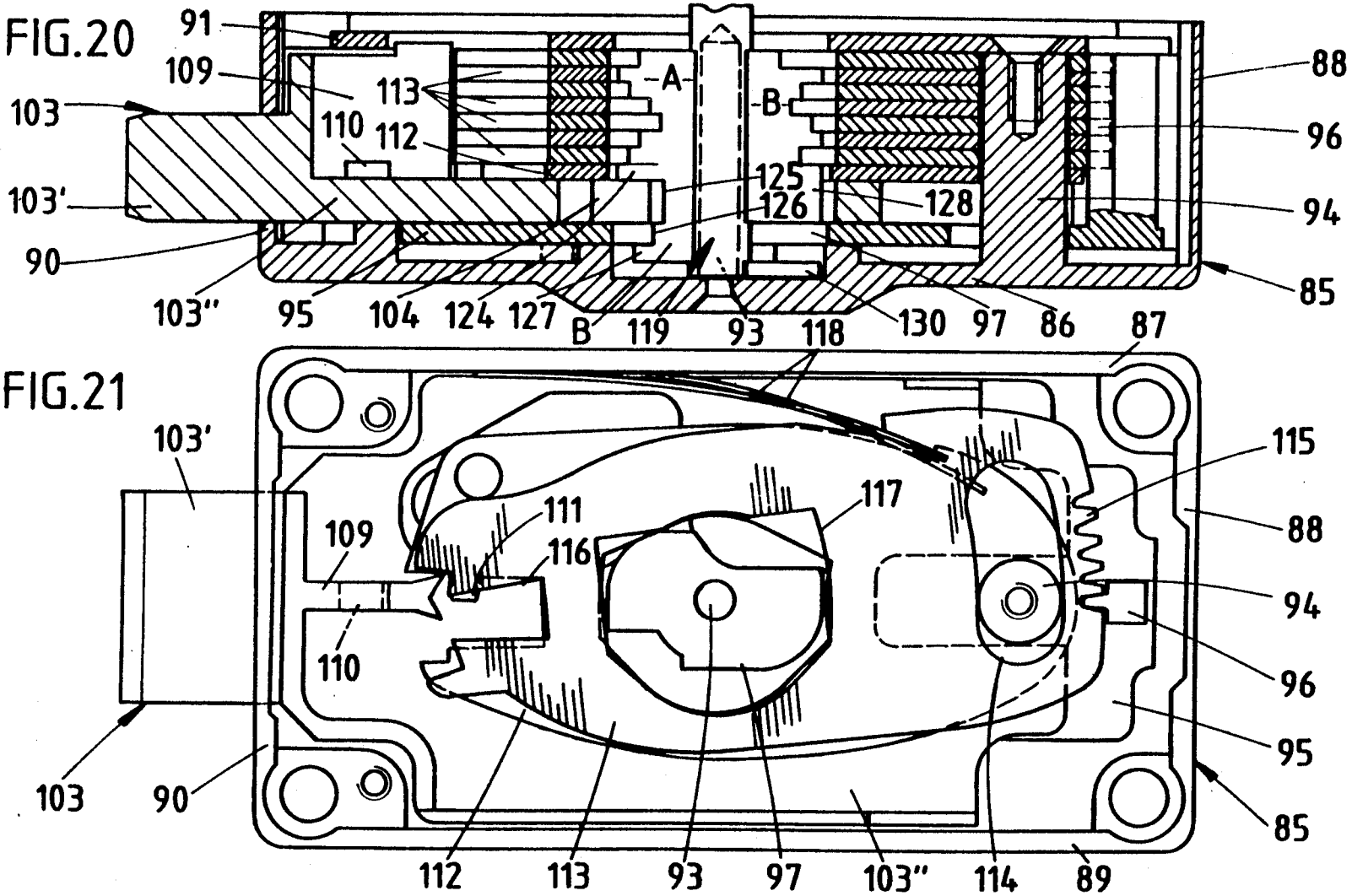
Figure 22:
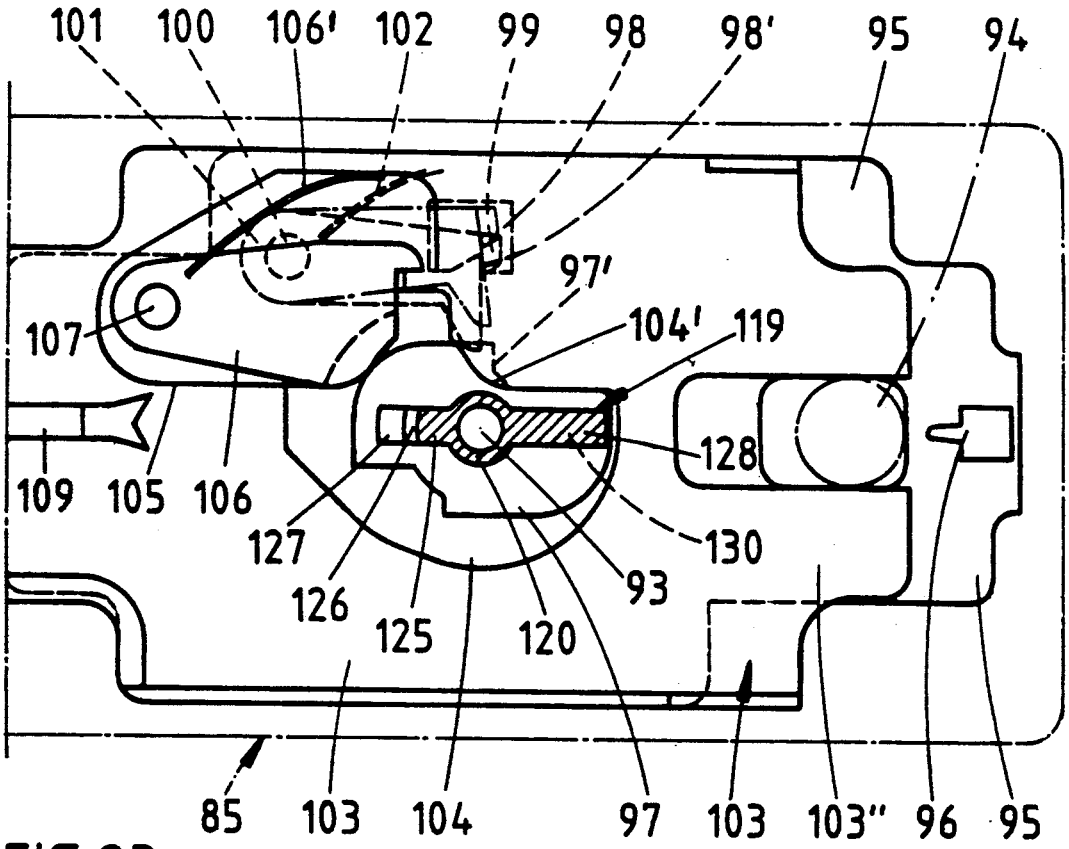
Figure 23:
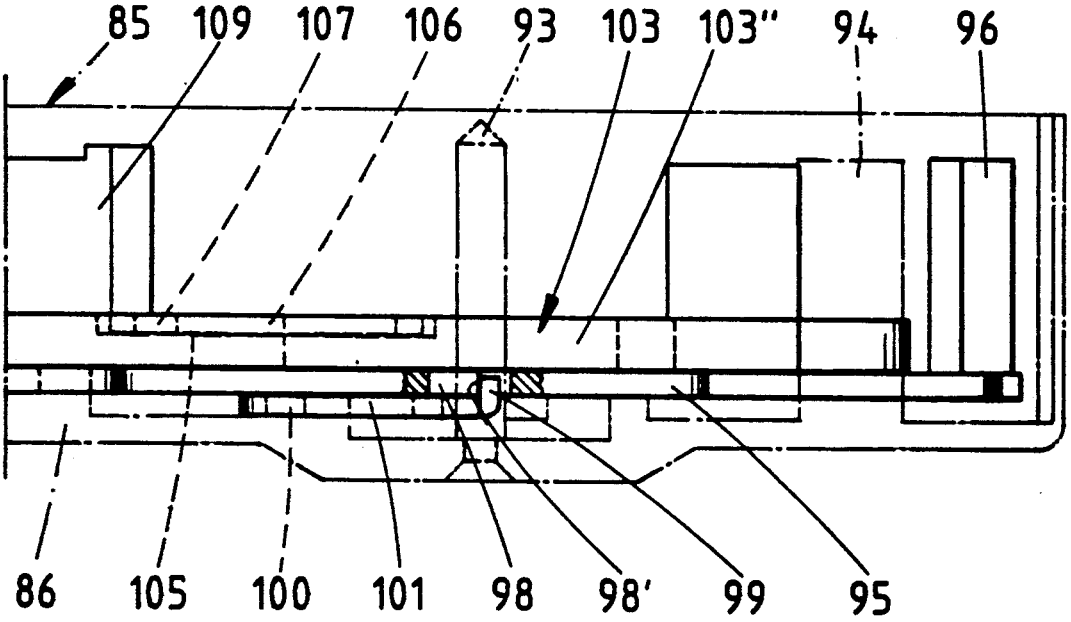
Figure 24:
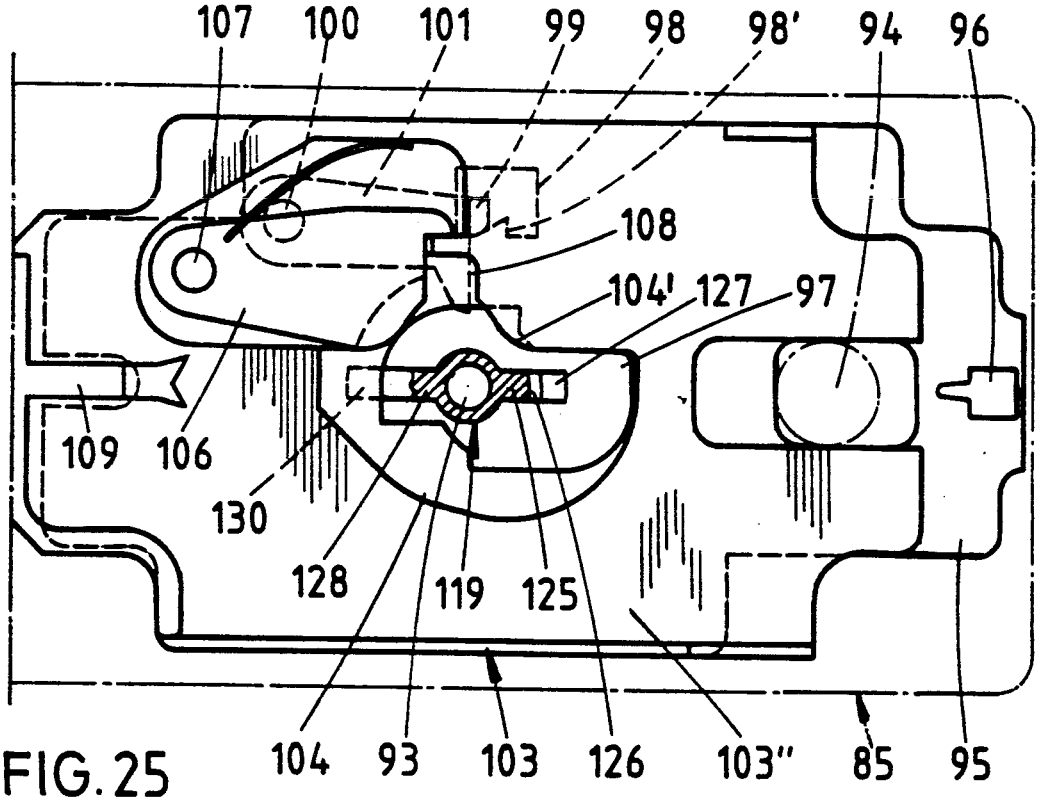
Figure 25:
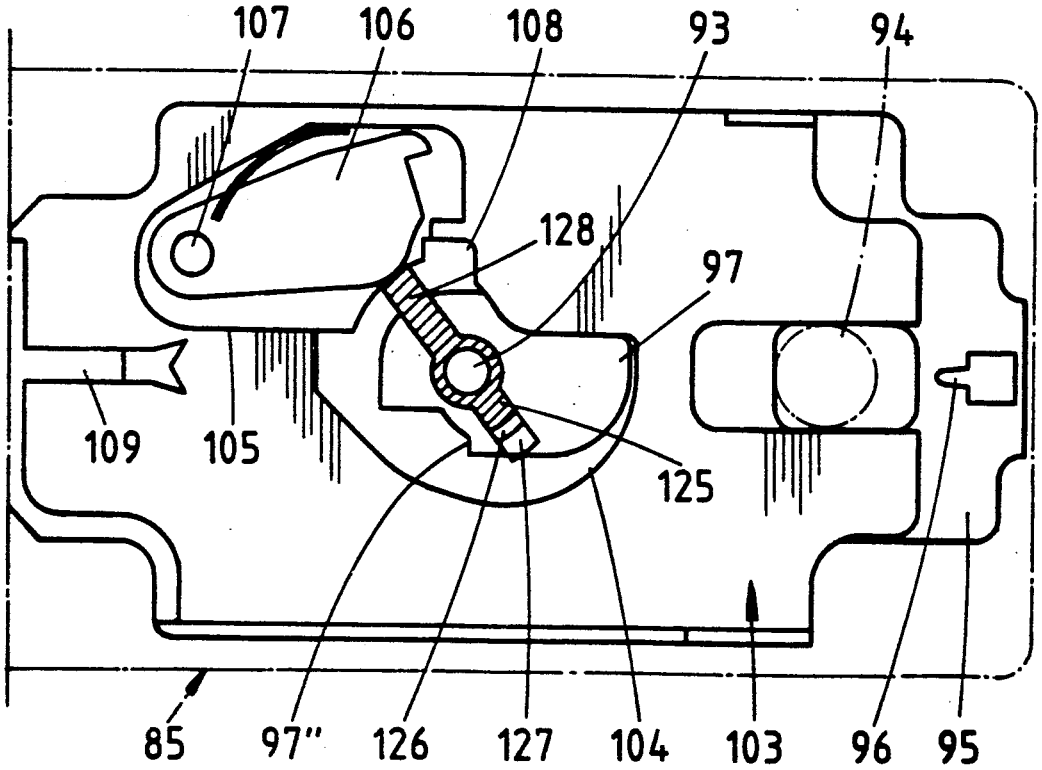
Figure 26:
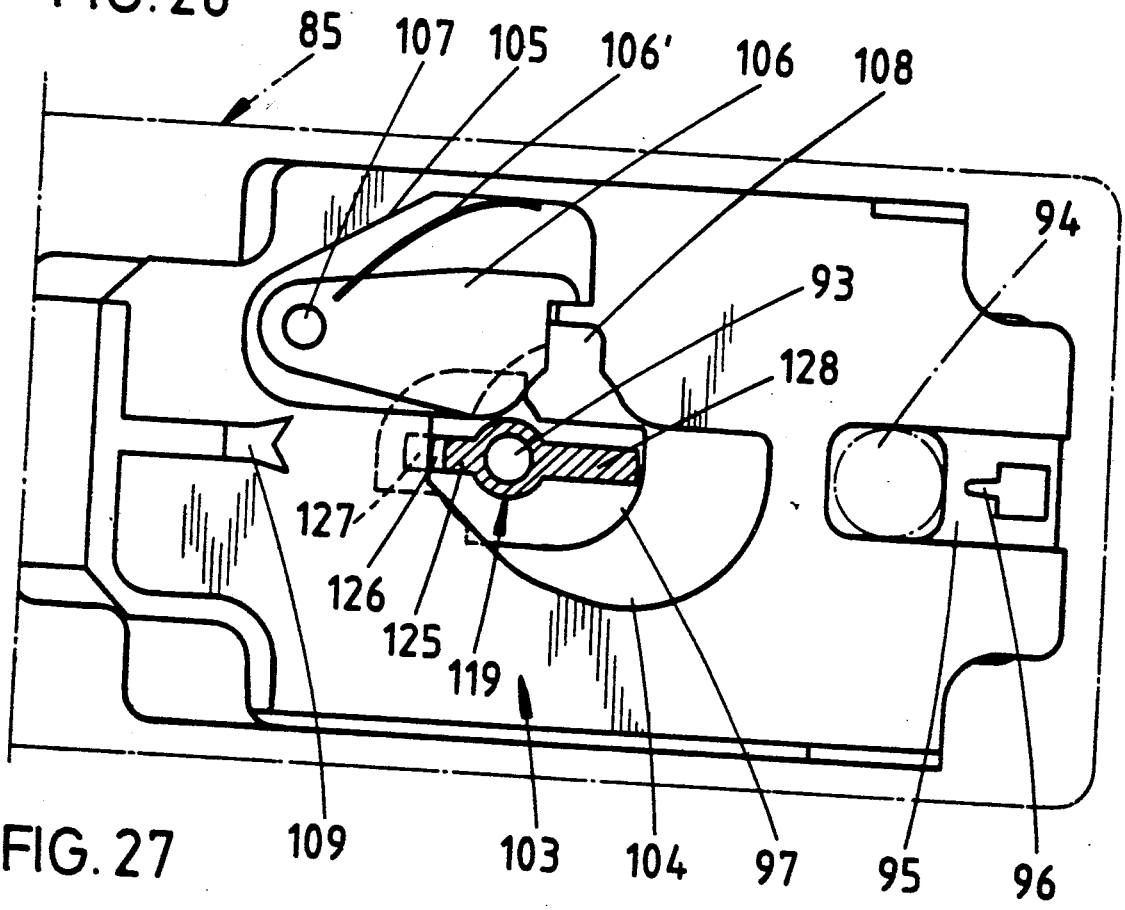
Figure 27:
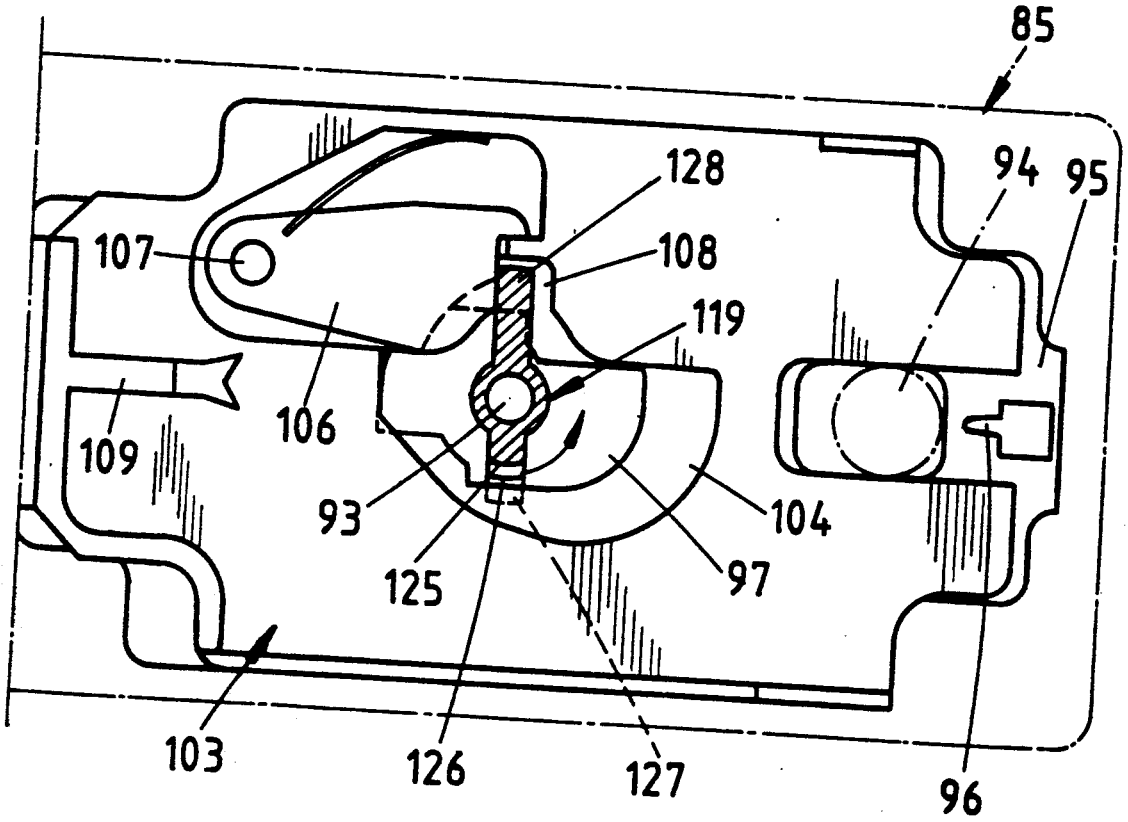

FIG. 18 a lock in elevation with bolt pushed forward and corresponding successor key, FIG. 19 a top view of the lock, seen in the direction of the lock cover, FIG. 20 a longitudinal section through the lock with the successor key inserted, FIG. 21 a top view of the lock, with the lock cover omitted and with tumblers in locking position, FIG. 22 a top view of the lock parts, with tumblers omitted and successor key inserted, corresponding to the forward-closed position of the bolt, FIG. 23 a side view of the lock parts shown in FIG. 22, FIG. 24 a showing corresponding to FIG. 22 but after a 180° locking rotation of the successor key, in which position the bolt is retracted over a part of the distance and the fixing-tooth carrier is in pushed-back position of release, FIG. 25 also a showing corresponding to previous FIGS. 22 and 24 with multi-bit key turned more than 180° in the position in which the successor key lifts a swing bolt and also shifts the tumblers, FIG. 26 a showing similar to the preceding Figures, in which the successor key is turned completely through 360° with bolt moved completely backward and fixing-tooth carrier assuming a locking position, FIG. 27 a subsequent showing, after FIG. 26, during the forward closing of the bolt.

The lock shown in FIGS. 18 to 27 has a box-like lock housing 85 with a lock bottom 86 and lock-box sidewalls 87, 88, 89 and 90 extending from it. The lock parts mentioned below are covered by a lock cover 91. The latter contains in the center a key insertion opening 92 which extends in the longitudinal direction of the lock.

From the lock bottom 86 there extends centrally a centering mandrel 93 which extends up into the key insertion opening. Between said mandrel and the lock-box sidewall 88 there extends a pin 94 integral with and extending from the lock bottom 86, against which pin the lock cover 91 also rests and into which a lock cover fastening screw engages. The pin 94 serves in part for a longitudinal guiding of a plate-shaped carrier 9 which is provided in the region between the pin 94 a.. the lock-box sidewall 88 with a fixing tooth 96 This tooth extends up to the bottom of the lock cover 91. In the central region, the carrier 95 is provided with a key-engagement opening 97. Above the latter there is a recess 98 which by means of a lower flank forms a blocking shoulder 98'. A bent portion 99 of a blocking lever 101 mounted below the carrier 95 and spring-urged in direction of engagement by means a leaf spring 102 comes in front of said shoulder.

Flat alongside the carrier 95 there is a bolt 103. It forms a thicker bolt head 103' which passes through the lock-box sidewall 90 and adjoining which there is a thinner bolt tail 103". The end of the latter is slotted for the guiding engagement of the pin 94. The bolt tail 103" is provided at its center with a control opening 104. On the side facing away from the carrier 95 there is present on the bolt a recess 105 to receive a bolt rocker 106. The latter is mounted around a bolt-side bolt 107 and serves in part to form the closure engagement niche 108 of the bolt control opening 104. A leaf spring 106' acts on this bolt rocker 106 in clockwise direction, the rocker receiving support on the lower flank of the recess 105.

Adjoining the bolt head 103' there is a turn 109 which extends in the locking direction of the bolt up to the lock cover 91. In the region between the bolt tail 103" and the turn projection 109 there is a blocking opening 110 for a blocking tooth 111 of a tumbler plate 112 which rests on the bolt tail 103" and is swingable around the pin 94. Above that plate there extend seven tumblers 113 of identical development. In contradistinction to the tumbler plate 112, the point of swing of the tumblers 113 is variable. For this purpose, the region of each tumbler 113 facing the fixing tooth 96 forms an arcuate slot 114 which is passed through by the pin 94. The edge which extends concentrically to the slot 114 is provided with a toothing 115. Depending on the basic position of each tumbler 113, the fixing tooth 96 engages into a corresponding tooth gap. The end of each tumbler 113 and the tumbler plate 112 which is opposite the toothing 115 is provided with a stepped-down turn opening 116. All tumblers form a central control opening 117 and are so acted upon by leaf springs 118 in counterclockwise direction that with the bolt 103 closed they rest on the turn projection 109; see FIG. 21.

With respect to the key shown in the Figures, it is a successor key 119. It has a key shaft 120 and a key handle 121. From the lower end of the key shaft 20 there extends an opening 122 of circular cross section for the entrance of the centering mandrel 93.

In radial direction there protrudes from the key shaft 120 a closing-code bit-step region A. It comprises seven bit steps 123 which serve for the arranging of the tumblers 113. In the extension of the closure-code bit-step region there is a supplementation region E. The bit step 124 which directly adjoins the bit steps 123 serves for the control of the tumbler plate 112. The next, wider bit step 125 is intended for the controlling of the bolt 103. It is then adjoined by a bit step 126 by means of which the release position of the carrier 95 can be brought about. The lowermost bit step 127, on its part, serves for controlling the blocking lever 101. Diametrically opposite the bit steps 124 to 127 the supplementation region E has a drive wing 128 which extends exclusively in the plane of the tumbler plate 112 and of the bolt tail 103". It is adjoined, with the formation of a gap 129 which is arranged at the height of the bit steps 126 and 127, by an anti-pullout wing 130. Furthermore, diametrically opposite the closing-code bit steps 123 there is an additional bit-step region B the bit steps 123' of which incorporate the new closure code.

The manner of closing is as follows:

The key can be removed only when the bolt 103 is pushed forward. If the locking code used, for instance, by a prior user is to be changed, then a prescribed successor key 119 is issued to the following user. It comprises the bit-step regions A, E and B. The bit-step region A corresponds in its locking code to the locking code used for the predecessor key while the additional bit-step region B incorporates the new locking code. Since the anti-pullout wing 130 lies on the same side as the bit-step region B, the wing serves as aid in orientation upon the insertion of the successor key 119 into the lock. The insertion movement is limited by the lock bottom 86 so that the corresponding bit steps are then aligned with the corresponding lock ward parts, see FIG. 20. Upon the locking rotation which then commences, the tumblers 113 are so swung by the bit steps 123 of the region A associated with the locking code that the turn openings 116 thereof lie coinciding one above the other and thus permit the withdrawal of the bolt 103, the turn projection 109 moving into the turn openings 116. This is possible because the tumbler plate 112 is simultaneously brought out of engagement by the bit step 124. During the locking rotation from the position in FIG. 22 into the position in FIG. 24, along with the bit step 125 which strikes a control edge 104', the bolt 103 is pulled back approximately one-third of its total closure path. The step 125 therefore effects a partial displacement of the bolt in order to show the authorization for resetting. Furthermore, the blocking lever 101 is lifted by the bit step 127 of the supplementation region E, its angle part 99 moving away from the blocking shoulder 98'; see the dash-dot showing in FIG. 22. In this way, the carrier 95 is released for displacement. The corresponding displacement of the carrier takes place in the manner that the bit step 126 strikes against a drive shoulder 97' of the key engagement opening 97. The carrying along of the carrier 95 into the position shown in FIG. 24 has the result that the fixing tooth 96 leaves the toothing 115 of the tumblers 113 In this position, which is turned 180°, the anti-pullout wing 130 is also swung below the carrier 95, so that the key can not be withdrawn from this position. Furthermore, the key can no longer be turned back out of this position since the blocking lever 101 has again dropped back into its starting position and thus lies within the region of turn of the bit step 127. The turning of the key in clockwise direction must therefore be continued. In accordance with FIG. 25, the drive wing 128 of the successor key 119 strikes in this connection against the bolt rocker 106. Furthermore, by means of the bit steps 123' of the additional bit-step region B, the spring-actuated tumblers 113 are shifted into their new basic position, as is possible because the fixing pin 96 is still in release position. During the further turning of the successor key 119 into the position shown in FIG. 26 and therefore after movement through a total angle of turn of 360°, the bit-step 126 of the supplementation region E comes against another driver shoulder 97" of the key engagement opening 97 of the carrier 95 and shifts it thus in toward locking direction, the fixing tooth 96 dropping into the corresponding tooth space of the toothing 115 of the tumblers 113 with locking of the different basic positions of the tumblers. Thereupon, during this remaining turning path, the drive wing 128 has entered into the closure engagement niche 108 and has thus completely moved the bolt back. In this position the blocking tooth 11 of the tumbler plate 112 engages into the blocking opening 110 of the turn projection 109, which is not shown. The successor key 119 cannot be withdrawn from this position since the bit-step engages below the carrier 95.

The forward closing of the bolt 103 now requires an opposite closing rotation and therefore in counterclockwise direction. In this connection the drive wing 128 extends into the closure engagement niche 108 of the bolt 103 which is formed in part by the bolt rocker 106 and carries it along with it. The space 129 between the drive wing 128 and the anti-pullout wing 130 has the effect that the key cannot come into to contact with the carrier and the blocking lever. During this closing rotation, the tumblers 113 are also displaced by the additional bit-step region B. After the carrying out of a rearward closing rotation of 180°, the bolt 103 then assumes its forward closed position from which the successor key 119 can be withdrawn. For the reward closing of the bolt, the successor key must then be so inserted that the additional bit-step region B and therefore the new region, lies on the left-hand side. Upon the then following closing rotation, the blocking lever 101 and the carrier 95 are not displaced. Only the tumblers are arranged correctly, so that only the bolt is closed backward via the drive wing 128 of the successor key 119. The rearward closing rotation is completed after about 180° so that the position in accordance with FIG. 26 is then again present.

A key which follows the successor key 119 would then have the appearance that it is provided with the bit-step region B above the bit-steps 124, 125, 126, 127. A new additional bit-step region would then be provided in diametrically opposite position.

From the foregoing it is clear that the change does not affect the supplementation region E. The later remains the same at all times. A variation is effected solely on the first bit-step region associated with the closing code.

Figure 28:
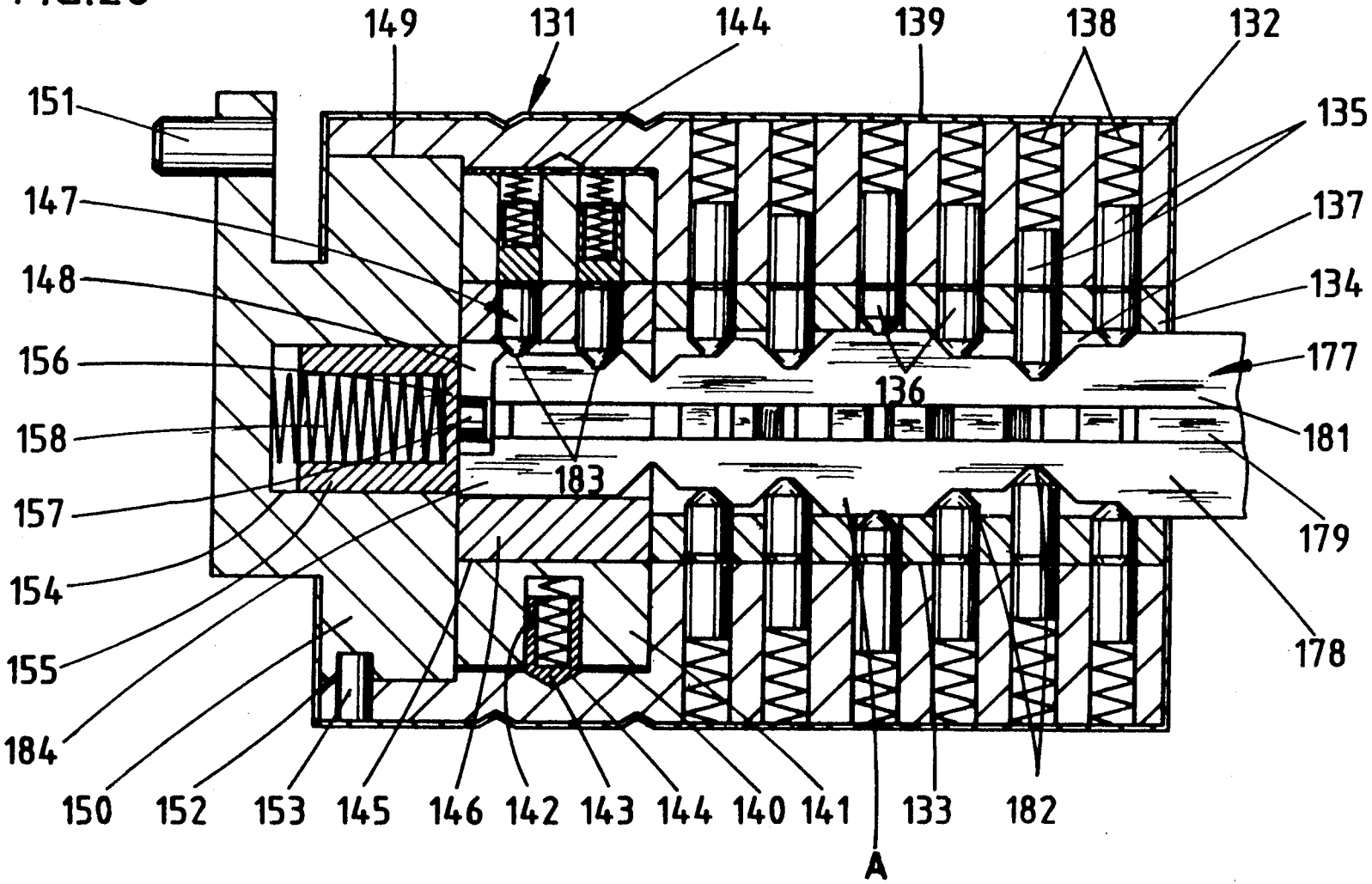
Figure 29:
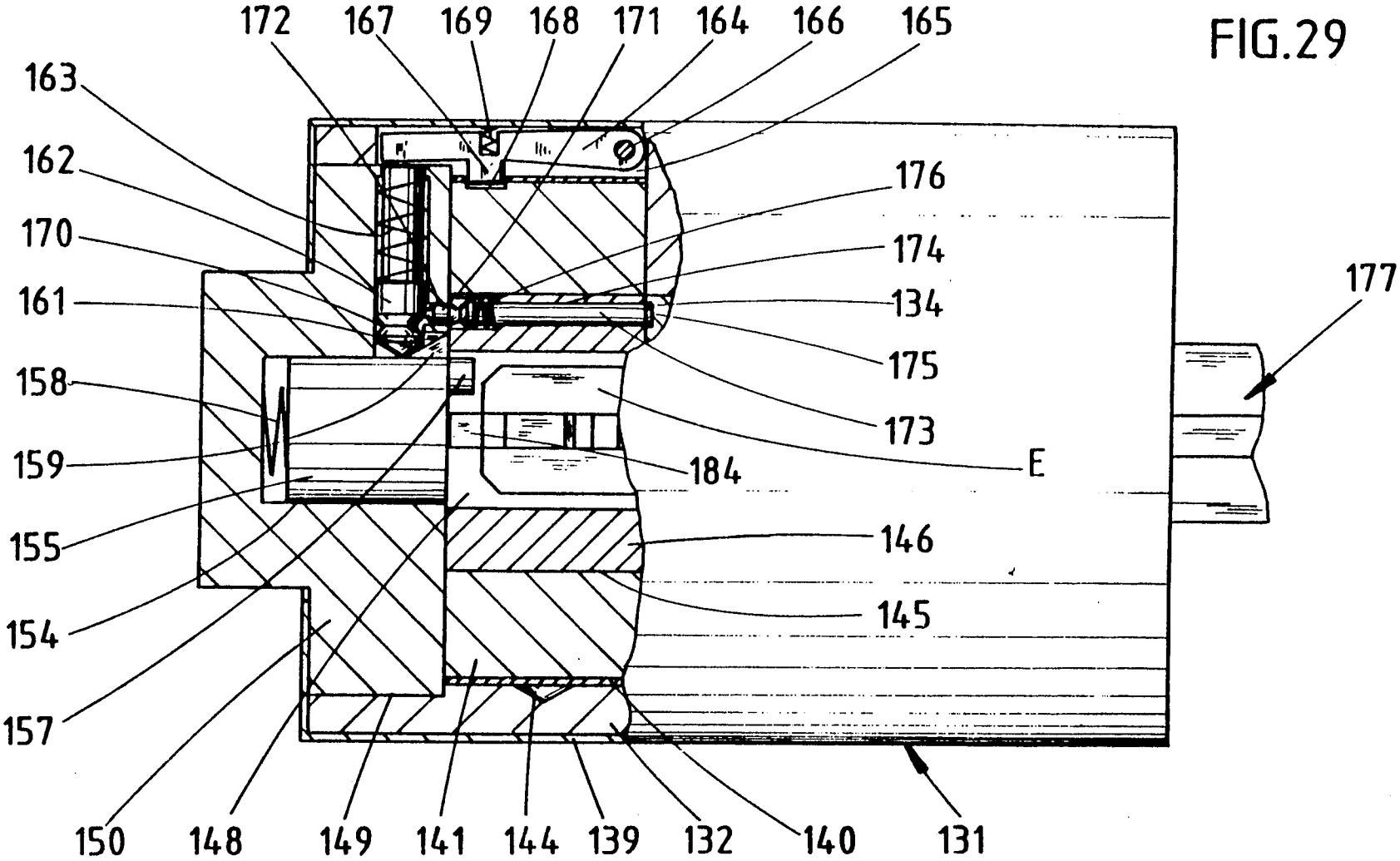
Figure 32:
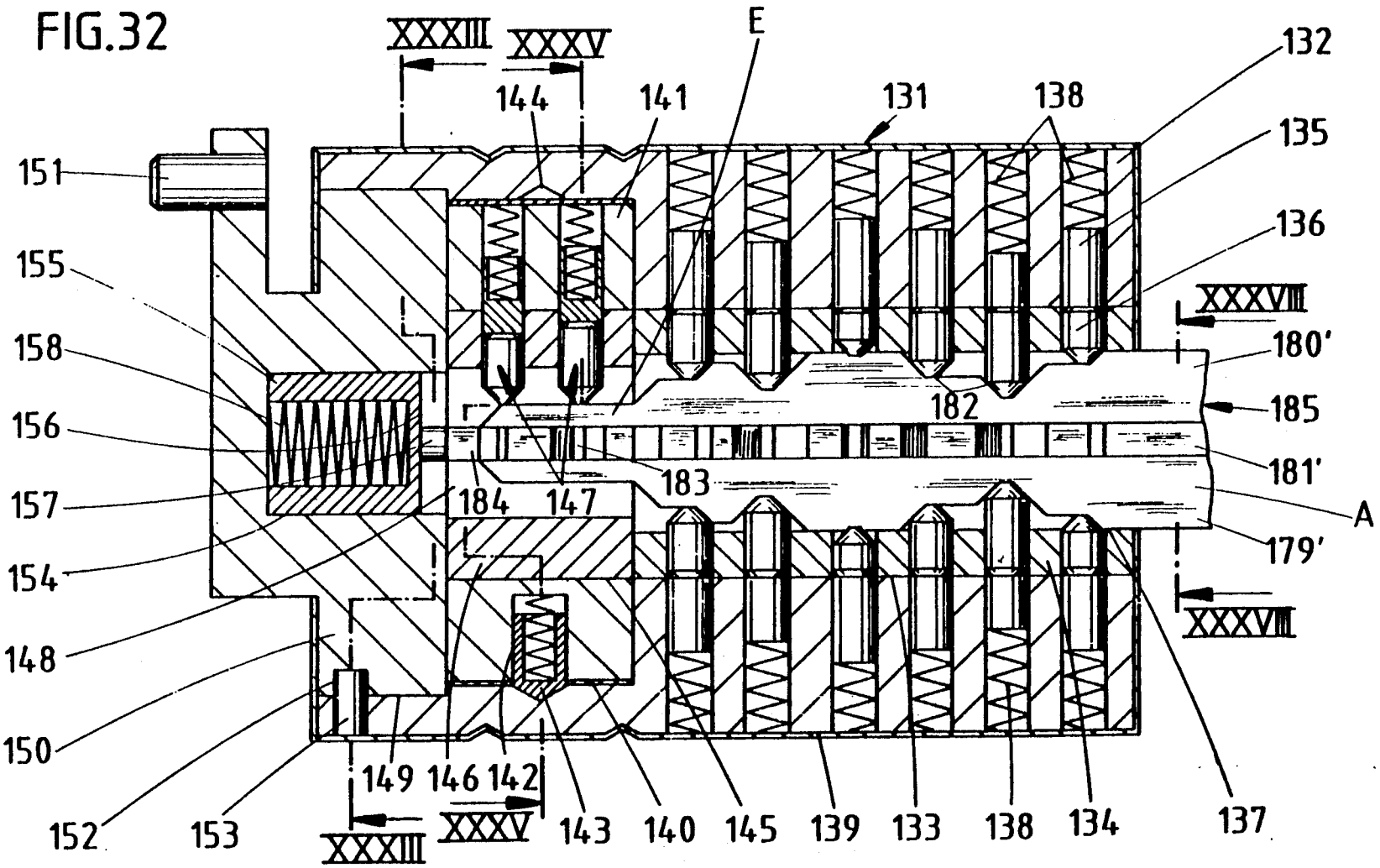
Figure 35:
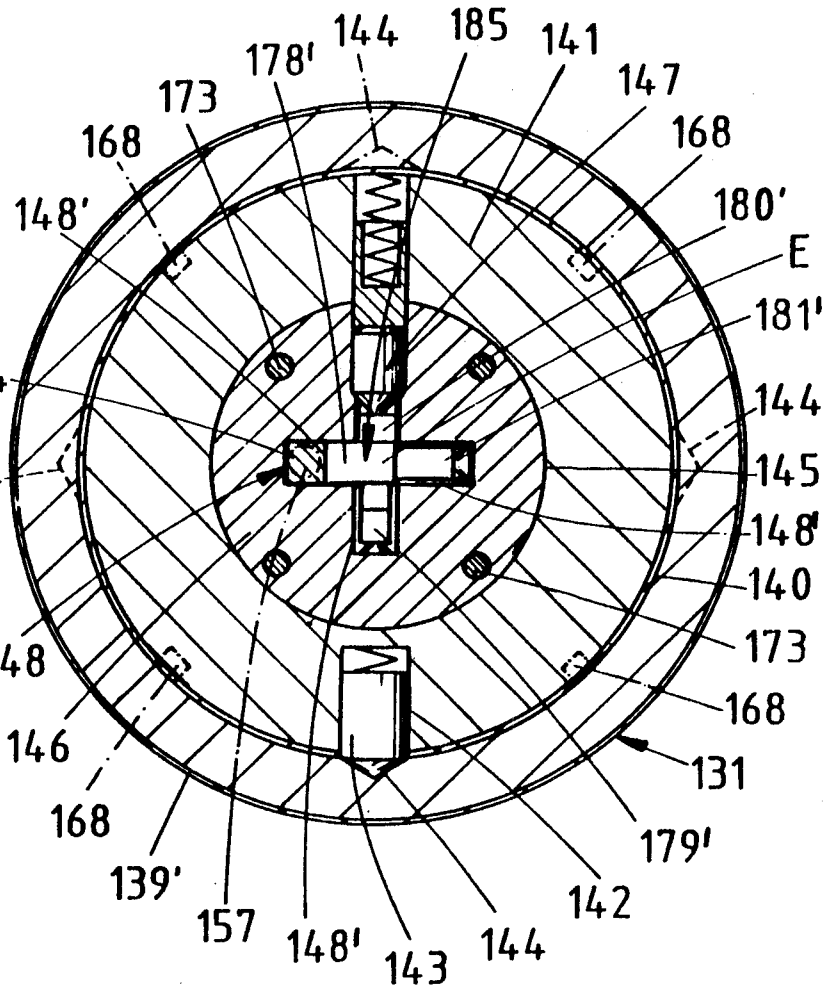
Figure 33:
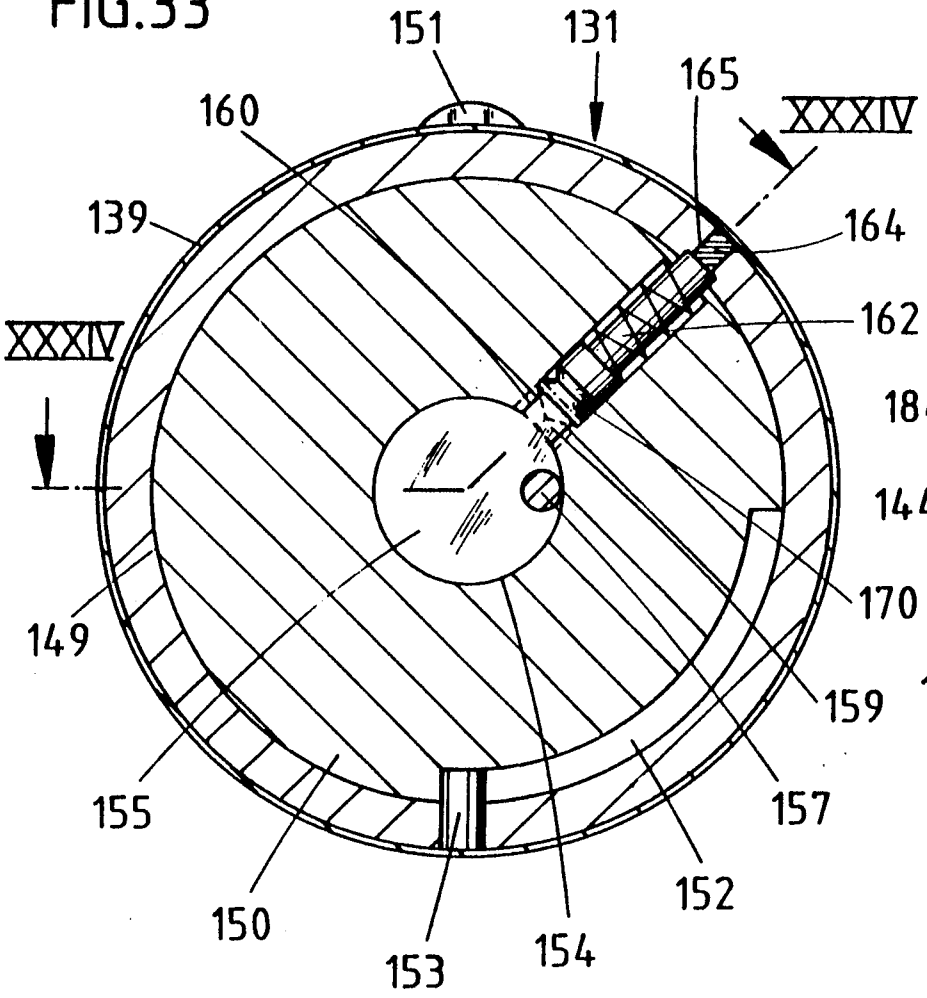
Figure 34:
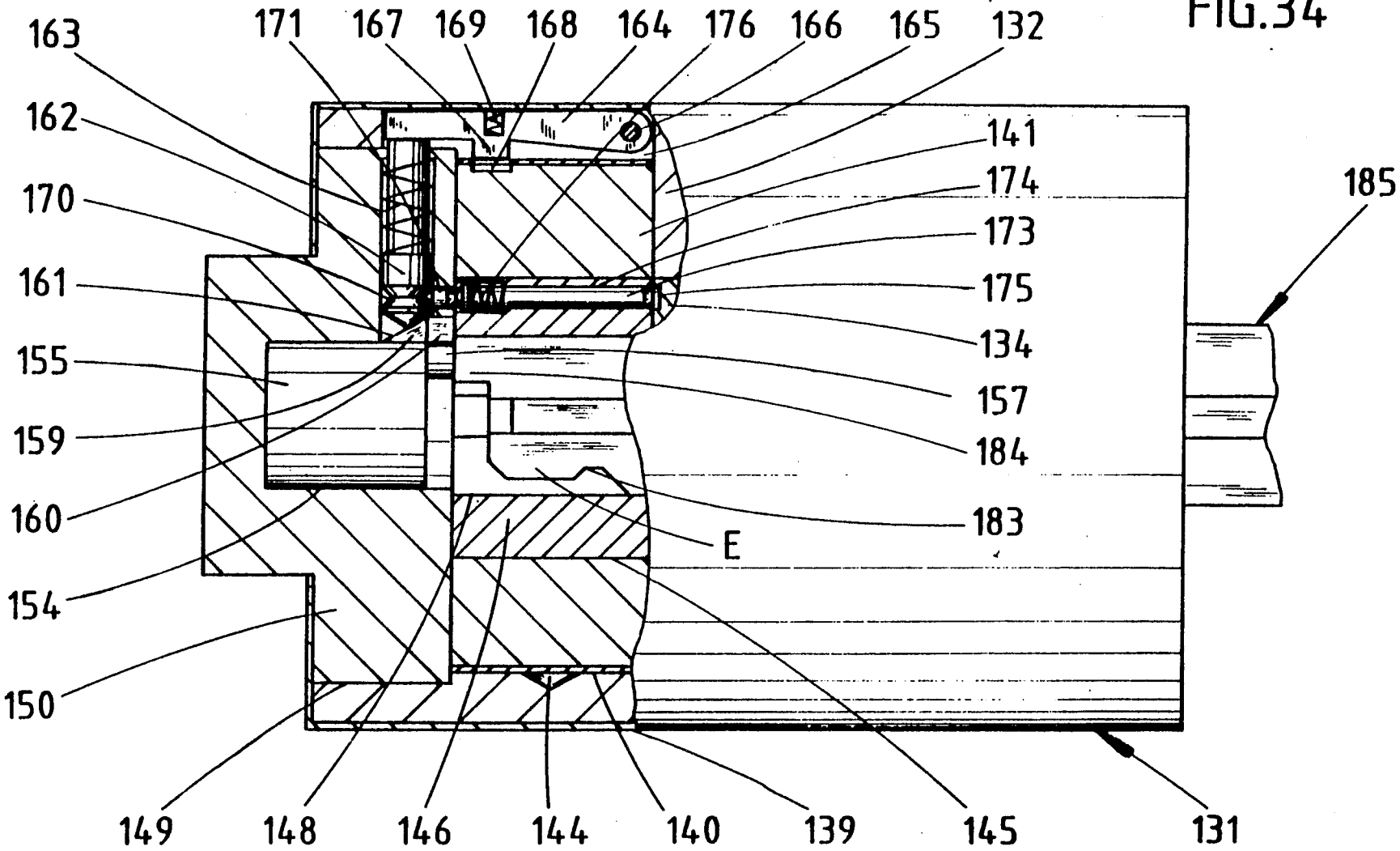
Figure 37:
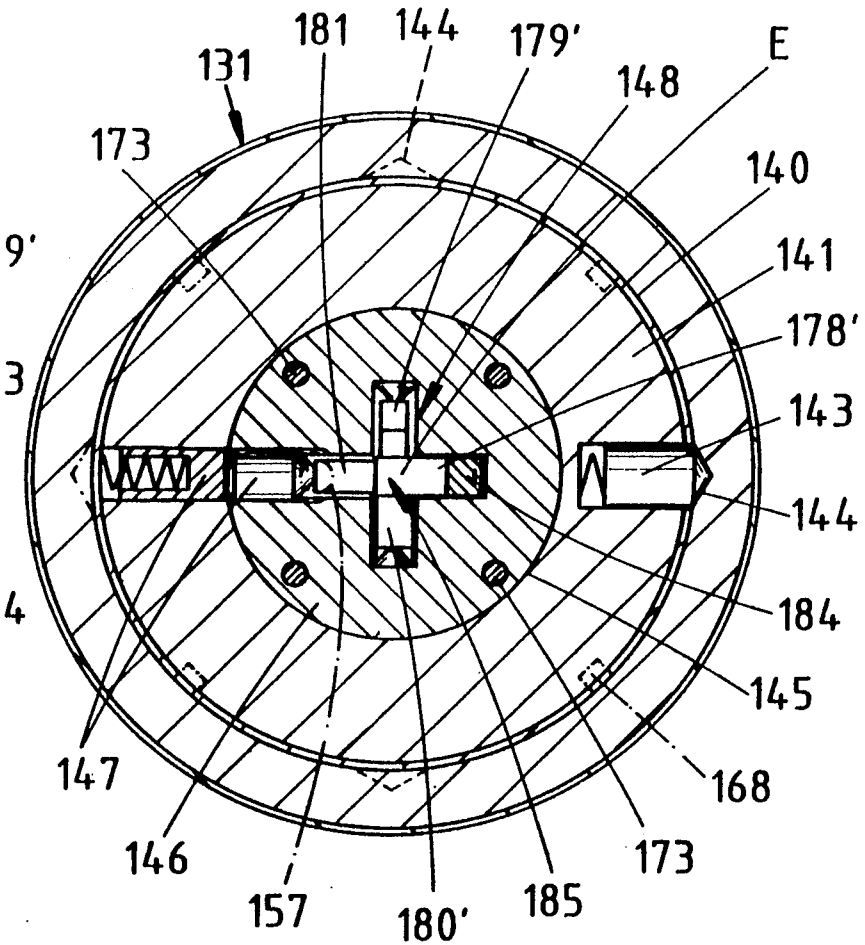
Figure 36:
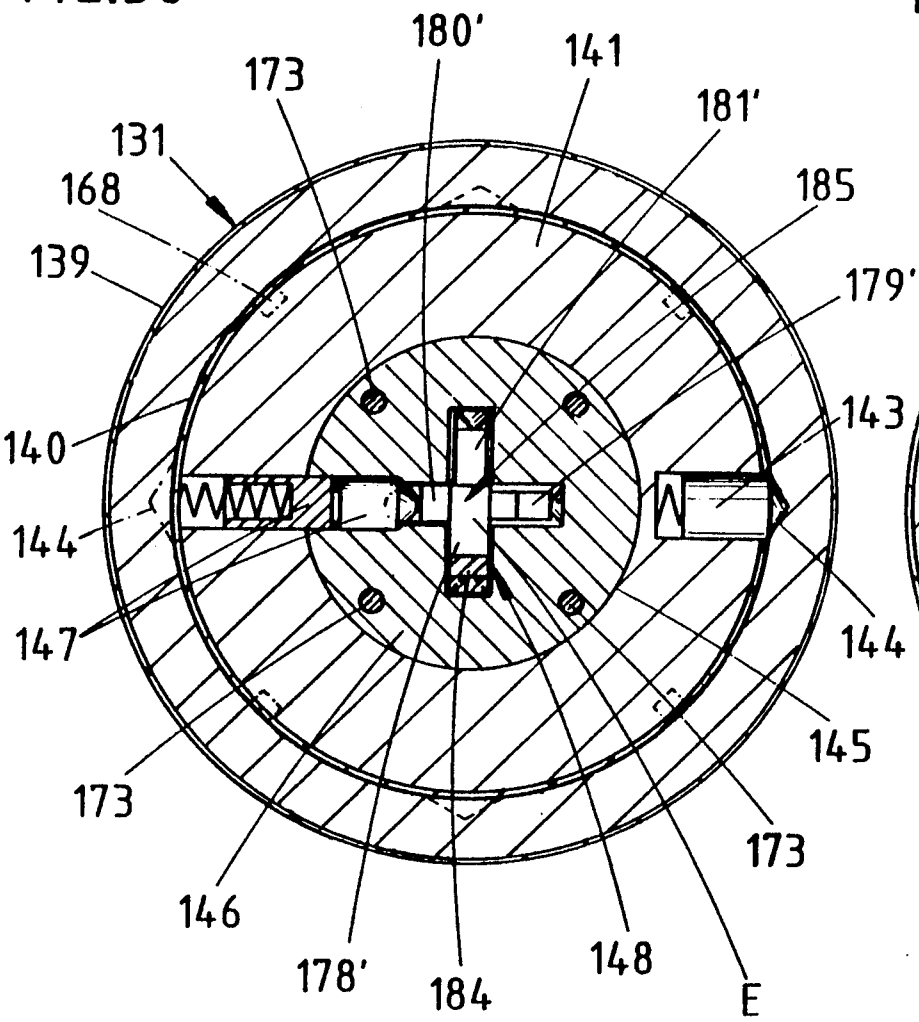
Figure 38:
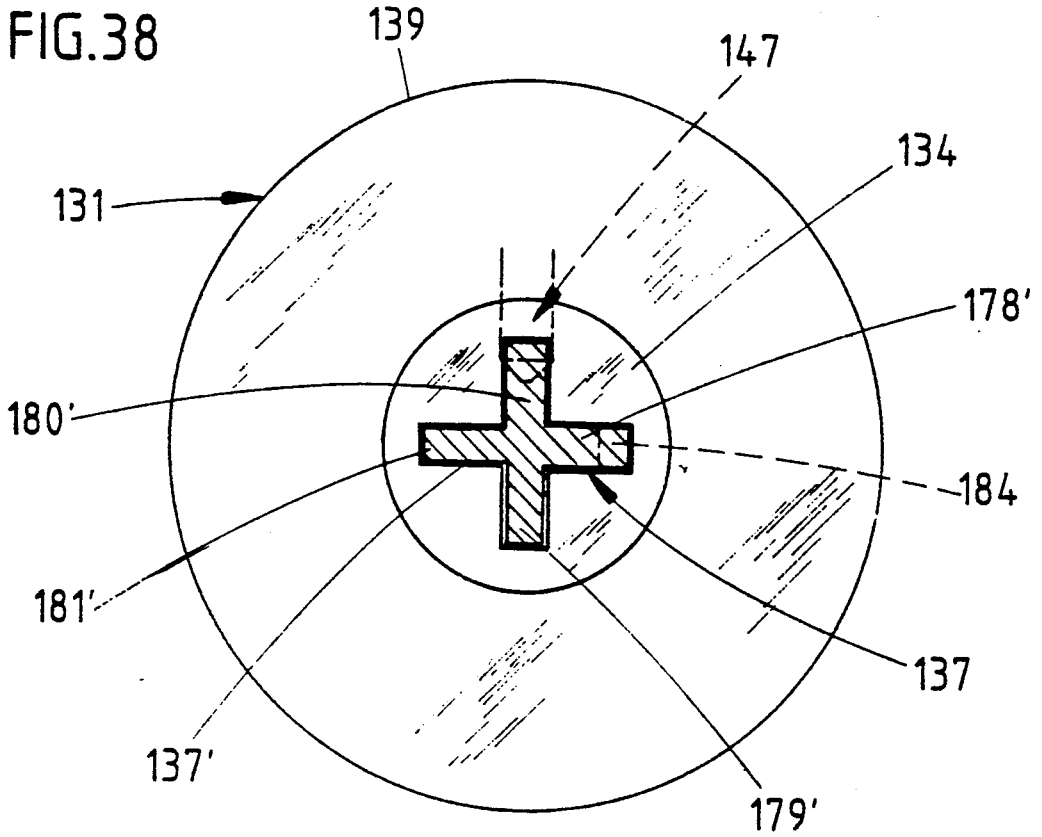
Figure 39:
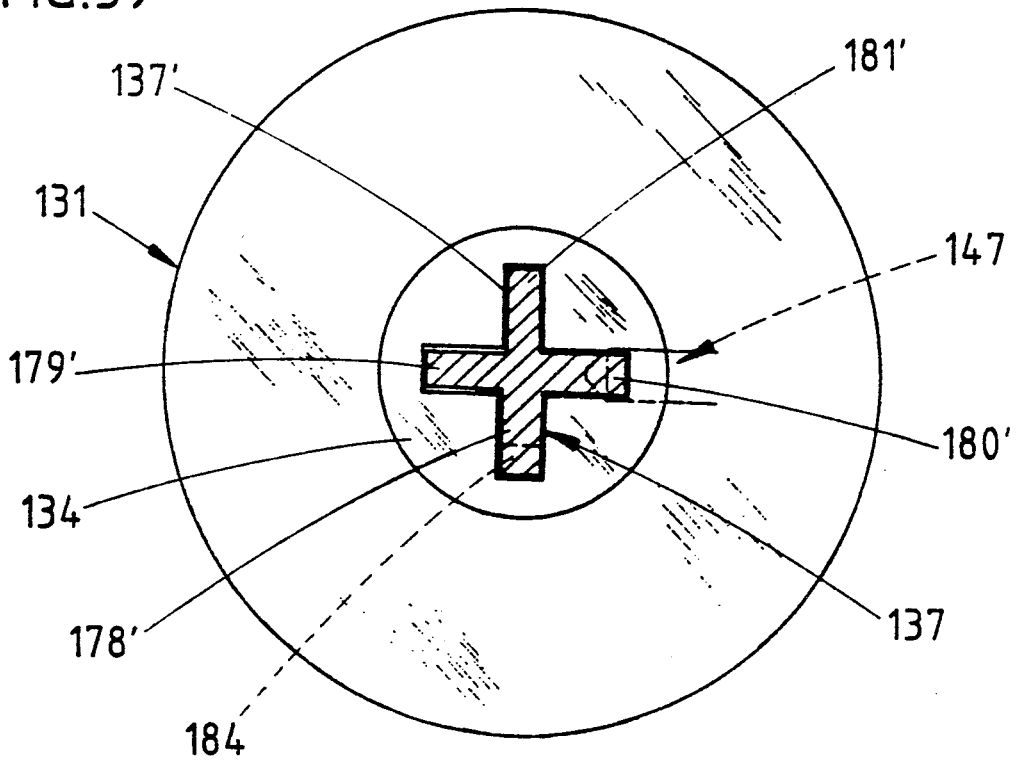

It is furthermore to be noted that the supplementation region E of the key enters into action only when the first region, bit-step region A, agrees with the closing code of the tumblers. If such agreement is absent, the tumblers prevent a closing rotation. The third category of structural form is now described. In detail, FIG. 28 shows a longitudinal section through a lock developed in the form of a closure cylinder, with key of cross-shaped section, FIG. 29 shows the closure cylinder with key introduced, partially in elevation and partially in a section turned 45°, FIG. 30 shows in perspective the key used in accordance with FIGS. 28 and 29, FIG. 31 shows in perspective a successor key of modified embodiment, FIG. 32 shows the successor key inserted into the closure cylinder, FIG. 33 is a section along the line XXXIII—XXXIII of FIG. 32, FIG. 34 is a section along the line XXXIV—XXXIV of FIG. 33, FIG. 35 is a section along the line XXXV—XXXV of FIG. 32, FIG. 36 is a section corresponding to FIG. 35, the successor key being turned 90°, FIG. 37 is a section corresponding to FIG. 36, with the successor key again inserted in a position shifted 90°, FIG. 38 is a section along the line XXXVIII—XXXVIII of FIG. 32, and FIG. 39 is a showing similar to FIG. 38, the key together with the cylinder core being turned 90°.

The lock which is developed as closure cylinder 131 has a housing 132 of circular shape in cross section. Within a central bore 133 it receives a cylinder core 134 which extends over somewhat more than half the length of the housing 132. Within the housing 132 and cylinder core 134 there are arranged four rows of housing pins 135 and core pins 136 at equal angles apart. Accordingly, the cylinder core has a key channel 137 of cross-shaped cross section into which the facing ends of the core pins 136 extend. Pin springs 138 act on the housing pins 135 which, in their turn, push the core pins in inward direction. In order that the pin springs 138 do not emerge from the bores that receive the housing pins 135, the housing 132 is covered by a shell 139.

From the side of the housing 132 opposite the cylinder core 134 a bore 140 of larger cross section than the core bore 133 is provided in it, a reset ring 141 being turnably housed therein. Said ring can be engaged in 90° positions. For this purpose, a blind hole 142 extends from the shell surface of the reset ring 141 in order to receive a detent pin 143 which is urged by spring in outward direction. The conical tip of said pin cooperates with four detent niches 144 lying in the same cross-sectional plane and distributed over the circumference. In each case, one of these detent niches 144 extends at the height of a row of tumbler pins.

Within a central bore 145 the diameter of which corresponds the core bore 133, a reset core 146 is mounted. The reset ring 141 and the reset core 146 serve to receive a single row of tumbler pins 147. They also consist of core pins and housing pins and are urged by spring in inward direction. The reset core 146 furthermore contains a cross-shaped channel 148 in the extension of the key channel 137. The cross arms 148' of said channel have the same arm width.

The bore 145 is continued on the other side of the reset ring 141 by a bore section 149 of larger cross section. A closure member 150 provided with an eccentrically arranged driver pin 151 extends in turnable manner into said section. The closure member 150 contains an arcuate slot 152 into which a stop 153 of the housing 132 which lies on the same cross sectional plane of the closure cylinder extends. The length of the bore slot 152 is so large that the closing rotation of the closure member of 150 is less than 90°.

A blind bore 154 extends from the end surface of the closure member 150 facing the reset core 146, in order to receive a coupling member 155 of pot shape. The bottom 156 of said pot faces the reset core 146 and bears an eccentrically arranged driver pin 157. The diameter of this pin is less than the width of the cross arms 148'. In the direction of its engagement the coupling member 155 is acted on by a compression spring 158. The coupling member 155 is made unturnable in the blind bore 154 by a radially aligned control wing 159 which lies at the height of the bottom 156 of the pot, for which wing longitudinal groove 160 extends from the blind bore 154.

The control wing 159 is provided with an oblique surface 161 which slopes down in the direction towards the rim of the pot. This surface cooperates with a conical tip of a control pin 162 which is arranged for displacement in radial direction within the closure member 150. A compression spring 163 arranged on its stepped-down shaft pushes the control pin 162 in the direction towards the oblique surface 161. The end of the control pin 162 which is towards the outside cooperates with a locking pawl 164 which is arranged in a longitudinal recess 165 extending from the shell side of the housing 132. The locking pawl 164 is a single-arm lever. Its mounting pin 166 lies close to the separation between reset ring 141 and housing 132. Approximately at the height of its center the locking pawl 164 forms a blocking projection 167 which points in the direction of the reset ring 141 and extends into one of four blocking niches 168 arranged spaced equally apart in circumferential direction. The engagement is brought about by a compression spring 169 which acts on the locking pawl 164. When the locking pawl 164 is engaged, the detent pin 143 also extends into one of the detent niches 144.

The control pin 162 then also serves for a further function. For this purpose it is provided near its conical tip with a control zone which is formed by a notch groove 170. The said control zone cooperates with a feeler pin 171 which is arranged crosswise to the direction of movement of the control pin. The control member 155 forms a suitable bore 172 for said pin. When the coupling member 155 is in engagement in the cross-shaped channel 148 the feeler pin 171 rests against the wall surface of the control pin 162. The feeler pin 171 extends in this connection beyond the separation surface between closure member 150 and reset core 146. In this connection it acts on one of four longitudinal pins 173 arranged equally apart on the circumference which are housed in corresponding longitudinal bores 174 which completely pass through the reset core 146. The longitudinal pin 173 which is acted on by the feeler pin 171 extends with its opposite end into one of four blocking openings 175 of the cylinder core 134 which are arranged spaced equally apart on the circumference. FIGS. 29 and 34 show that the longitudinal pins 173 are acted on in each case by a compression spring 176 in direction opposite their engagement.

The key channel 137 of the cylinder core 134 has its cross arms aligned with those of the cross-shaped channel 148 in the reset core 146. One of the cross arms 137' is narrower than the other cross arms; see in particular FIGS. 38 and 39.

The closure cylinder 131 shown in the drawing can be closed by means of a key 177 shown in FIGS. 28 and 30. The key is of cross-shape in cross section and forms two thinner sections 178 and 179 of the cross which are arranged at a right angle to each other They correspond in their thickness to the width of the cross arm 137'. The other sections 180, 181 of the cross correspond to the width of the other cross arms of the key channel 137 and also to the width of the cross arm 148' of the cross-shaped channel 148 present in the reset core 146.

The key 177 has a first region A which is associated with the closure code and which extends up to the place of separation between cylinder core 134 and reset core 146. The supplementation region E which causes a resetting joins it from that place on. According to FIG. 28, a resetting has already been effected. The sections 178 to 181 of the cross are provided at the height of region A with closure notches 182. They represent the closure-code notch region. With the key 177 inserted, therefore, all housing pins 135 and core pins 136 are so aligned that their place of separation lies at the height of the outer surface of the cylinder core; see FIG. 28.

The supplementation region E which adjoins the first region A has control notches 183 only at the cross-shaped section 181. The other cross sections are without closure notches in the region there. By means of the control notches 183 the spring actuated tumbler pins 147 are so aligned that their place of separation lies at the height of the outer surface of the reset core 146. A nose 184 then extends from the free front end of section 178. When the key 177 is inserted, however, this nose is shifted at an angle to the driver pin 157 and accordingly does not act on the driver pin. With the key 177 completely inserted, the nose 184 extends furthermore to the place of separation between reset core 146 and closure member 150. This means that the control pin 162 is then also not displaced The blocking engagement between locking pawl 164 and reset ring 141 is thus assured. Upon a closing turning of the key 177, the cylinder core 134, the reset core 146, and, via the coupling member 155, the closure member 150 are carried along. The connection between the two cores 134 and 146 is assured in this connection also by the one longitudinal pin 173; see FIG. 29. The reset ring 141 remains in its position upon this closing rotation, which amounts to less than 90°. This means that the key can not be withdrawn in the forward-closed position. The withdrawal thereof rather requires a turning back of the cores 134, 146 into their initial position.

To be sure, the key 177 could be inserted turned by an angle of 90°. However, no arranging of the tumbler pins 147 then takes place.

If the closing of the closure cylinder is to be changed, a successor key 185 is turned over to the new user. This key is developed similar to the predecessor key 177. The successor key 185 also consists of the two regions A and E. However the cross-shaped sections 179' and 181' are now thinner than the predecessor key 177. This means that their thickness corresponds to the width of the cross arm 137' of the cross-shaped channel 137. The other sections 178' and 180' are now developed with such a thickness that the width corresponds to the other cross arms of the key channel 137.

If this successor key 185 is inserted into the closure cylinder, then the position shown in FIGS. 32, 33, 34, 35, and 38 is obtained. Therefore only the housing pins 135 and core pins 136 are positioned by the first region A. The cross-shaped section 180', which is free of closure notches in the supplementation region E, does not adjust the tumbler pins 147. On the other hand, the nose 184 of the cross-shaped section 178' strikes the driver pin 157 and thus moves the coupling member 155 against spring action. In the end position of the coupling member 155, the driver pin 157 has then left the corresponding cross arm 148' of the cross-shaped channel 148. At the same time as the displacement of the coupling member 155, the control pin 162, via its control wing 159, is moved outward in radial direction. Its end swings the locking pawl 164 against spring action, its blocking projection 167 releasing the facing blocking niche 168. With the displacement of the blocking pin 162, the notch groove 170 also comes into alignment with the feeler pin 171, so that the longitudinal pin 173, via the compression spring 176, now assumes the position shown in FIG. 34 and thus eliminates the combination engagement between cylinder pawl 134 and reset pawl 146. Upon a closing rotation by means of the successor key 185 by 90°, the cylinder core 134 is thus carried along, together with reset core 146 and reset ring 141. The closing displacement is limited by the drive pin 157 which then engages into the next cross arm 148' of the key channel and therefore after a closing turn of 90°. The position shown in FIGS. 36 and 39 is then present. Further turning of the key forward or backward is then not possible. If the closure cylinder 131 is now to be actuated in the normal manner, the successor key 185 is to be withdrawn and inserted in an angular position shifted by 90° in order to bring the control notches 183 into engagement with the tumbler pins 147. In exactly the same way as in the case of the predecessor key, an incorrect insertion of the successor key 185 does not result in any closing action.

If necessary, a modified new successor key can be inserted which changes the closing of the closure cylinder and excludes the previously used successor key 185. Also in the case of this version there is a compulsory sequence in the use of the successor key. It is not possible to skip over the use of a successor key.

I claim:

1. A closure system including a lock and a plurality of keys, the lock having tumbler elements, a closure of the lock being determined by mechanical or magnetic control of the tumbler elements in a variable manner, wherein a closure code of the tumbler elements of the lock is established successively by a first key and each successor key of a succession of a plurality of keys, the closure code corresponding initially to a coding of said first key of the plurality of keys and is variable by a shifting of at least one tumbler element within the lock to the coding of a next successor key of the plurality of keys; and wherein each successor key is divided into a first region which cooperates exclusively with the closure code of the tumbler elements and a second, supplementation region, which enters into action when the first region agrees with the closure code of the tumbler elements, said first and said second regions of each successor key allowing for displacement of the tumbler elements upon insertion of a corresponding successor key into the lock; and said supplementation region shifts the tumbler element into the position actuated by the supplementation region of the next successor key of said plurality of keys; and wherein said lock further comprises a plurality of carriers, individual ones of said tumbler elements being carried by respective ones of said carriers, each of said carriers being rotatable about an axis, a tumbler element being displaceable in its carrier in a direction parallel to the axis of the carrier.

2. A closure system according to claim 1, wherein the lock operates by a rhythmic recurrence in the shifting of the tumbler elements; and wherein the axes of rotation of the respective carriers are spaced apart from each other.

3. A closure system including a lock and a plurality of keys, the lock having tumbler elements, a closure of the lock being determined by mechanical or magnetic control of the tumbler elements in a variable manner, wherein a closure code of the tumbler elements of the lock is established successively by a first key and each successor key of a succession of a plurality of keys, the closure code corresponding initially to a coding of said first key of the plurality of keys and is variable by a shifting of at least one tumbler element within the lock to the coding of a next successor key of the plurality of keys; and wherein each successor key is divided into a first region which cooperates exclusively with the closure code of the tumbler elements and a second, supplementation region, which enters into action when the first region agrees with the closure code of the tumbler elements, said first and said second regions of each successor key allowing for displacement of the tumbler element upon insertion of a corresponding successor key into the lock;

said supplementation region shifts the tumbler element into the position actuated by the supplementation region of the next successor key of said plurality of keys;

the lock has a pusher and permanent magnets, there being a magnetic coding formed of individual ones of the permanent magnets which are arranged in openings of the pusher to be lifted out of a blocking position by correspondingly positioned magnetization regions of a key upon orienting the key in parallel position to the pusher;

upon a displacing of the pusher into a lock-open position, some of the permanent magnets serve as recoding magnets for changing a magnetic coding, the permanent magnets are shiftable relative to a wide surface of the pusher from one position into another position; and a displacement of the recoding magnet takes place simultaneously with a displacement movement of the pusher in response to operation of the successor key.

4. A closure system according to claim 3, wherein the lock further comprises a blocking plate having a longitudinal slot, lying along a direction of displacement, the blocking plate being arranged below the pusher; and a recoding magnet extends with its end facing a successor key in unraised position into the longitudinal slot.

5. A closure system according to claim 4, wherein one of the permanent magnets has an end facing a key; and wherein there is a blocking opening in said blocking plates, and after lifting the permanent magnet out of the blocking-plate blocking opening, the permanent magnet is positionable with its end facing the key into an adjacent blocking-plate longitudinal-slot opening.

6. A closure system according to claim 5, wherein the permanent magnet is positionable by a pendulum movement around the opposite end of the permanent magnet.

7. A closure system according to claim 5, wherein key magnetization pulls a permanent magnet end into the blocking-plate longitudinal-slot opening.

8. A closure system according to claim 5, wherein an obstacle is formed as a control element which is fixed in position;

the positionable permanent magnet is a control magnet for the control element; and the positionable magnet end is extendable into blocking-plate longitudinal-slot openings.

9. A closure system according to claim 5, wherein at least one of the permanent magnets is turnable with its end in a position for facing a successor key, after removal from the blocking-plate blocking opening within the pusher, around a transverse axis, after displacement of the pusher by 180° such that an end of the permanent magnet having opposite polarity to the first-mentioned end then faces the successor key.

10. A closure system according to claim 9, wherein the blocking-plate blocking opening extends into a blocking-plate longitudinal-slot opening to join a transverse slot extending in T-shaped arrangement with said longitudinal slot opening.

11. A closure system according to claim 9, wherein an obstacle is formed as a control element which is fixed in position; and the turnable permanent magnet is a control magnet for the control element.

12. A closure system according to claim 3, wherein the lock comprises an obstacle, and a recording magnet which has been lifted-out, upon the displacement movement of the pusher, abuts said obstacle, said obstacle being in a path of displacement of the pusher.

13. A closure system according to claim 12, wherein an additional coding of a successor key enables the obstacle to be moved into its active position prior to a displacement of the pusher.

14. A closure system according to claim 12, wherein the lock comprises a cover having a transverse longitudinal groove; and the obstacle is formed by a transverse edge of the longitudinal groove, which groove extends in direction of a displacement of the pusher and is located in the cover above the pusher.

15. A closure system according to claim 12, wherein the lock includes a plurality of carriers which are connected with each other and turnable in the pusher, each of which carriers being provided with at least one of said recording magnets, the recoding magnets passing one after the other, due to a turning movement of the carrier, into a position in front of the obstacle and out of this position, respectively.

16. A closure system according to claim 15, wherein the lock comprises spring means and a release device operative to release the spring means upon a stepwise rotation of a recoding-magnet carrier.

17. A closure system according to claim 16, wherein the spring means is cocked by displacement of the pusher.

18. A closure system according to claim 15, wherein the turnable carriers are in toothed engagement with each other.

19. A closure system according to claim 15, wherein the obstacle is formed as a control element which is fixed in position; and wherein at least one of said carriers is turnably associated with the pusher and has at least one recoding magnet and a plurality of switch-cam edges, the carrier moving with one of the plurality of switch-cam edges against said control element; and said control element is shifted into the path of the edge of a switch cam by a control magnet which is lifted out by means of the successor key.

20. A closure system according to claim 19, wherein the control element is formed as a multi-member pawl, and the turnable carrier is formed as a ratchet wheel.

21. A closure system according to claim 19, wherein the switch-cam edges are arranged in the form of a Maltese cross.

22. A closure system according to claim 19, wherein one of said magnets is a control magnet; and the control magnet strikes against the control element which, in a basic position of the pusher, is secured against swinging along after a short idle stroke of the pusher.

23. A closure system according to claim 21, wherein the Maltese cross extends into an inner opening of the control element, and said inner opening forms the obstacle on one edge.

* * * * *